US006336851B1

(12) United States Patent
Shendon

(10) Patent No.: US 6,336,851 B1
(45) Date of Patent: Jan. 8, 2002

(54) SUBSTRATE BELT POLISHER

(75) Inventor: Norm Shendon, San Carlos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/368,446

(22) Filed: Aug. 4, 1999

Related U.S. Application Data

(63) Continuation of application No. 08/568,188, filed on Dec. 5, 1995, now Pat. No. 5,961,372.

(51) Int. Cl.[7] ..... B24B 21/00
(52) U.S. Cl. ..... 451/303; 451/296; 451/307
(58) Field of Search ..... 451/41, 59, 296, 451/299, 303, 307, 56

(56) References Cited

U.S. PATENT DOCUMENTS

| | | | | |
|---|---|---|---|---|
| 3,888,050 A | * | 6/1975 | Elm | |
| 4,676,029 A | * | 6/1987 | Palmer | |
| 5,016,400 A | * | 5/1991 | Weber | |
| 5,127,196 A | | 7/1992 | Morimoto et al. | 451/285 |
| 5,335,453 A | | 8/1994 | Baldy | |
| 5,484,323 A | | 1/1996 | Smith | 451/56 |
| 5,558,568 A | * | 9/1996 | Talieh et al. | 451/303 |
| 5,562,524 A | | 10/1996 | Gill et al. | 451/287 |
| 5,575,707 A | | 11/1996 | Talieh et al. | |
| 5,593,344 A | * | 1/1997 | Weldon et al. | 451/307 |
| 5,692,947 A | * | 12/1997 | Talieh et al. | 451/307 |
| 5,961,372 A | | 10/1999 | Shendon | |

FOREIGN PATENT DOCUMENTS

| | | |
|---|---|---|
| JP | 63267155 | 11/1988 |
| JP | 02269552 | 11/1990 |
| JP | 02269553 | 11/1990 |

* cited by examiner

*Primary Examiner*—Eileen P. Morgan
(74) *Attorney, Agent, or Firm*—Fish & Richardson, P.C.

(57) ABSTRACT

This invention relates to a flexible membrane polishing belt against which a substrate, for example a semiconductor wafer, is polished using chemical mechanical polishing principles. A fluidized layer is provided on a surface of a polishing member backing assembly which urges the moving polishing membrane toward the substrate held in a polishing head to be polished. The linear motion of the belt provides uniform polishing across the full width of the belt and provides the opportunity for a chemical mechanical polishing to take place. Several configurations are disclosed. They include belts which are wider than the substrate being polished, belts which cross the substrate being polished, but which provide relative motion between the substrate and the polishing belt, and polishing belt carriers having localized polishing areas which are smaller than the total area of the substrate to be polished. Only a small area on the surface of the substrate is in contact with polishing membrane but the motion of the carrier with respect to the substrate is programmed to provide uniform polishing of the full substrate surface, as is each configuration described.

7 Claims, 18 Drawing Sheets

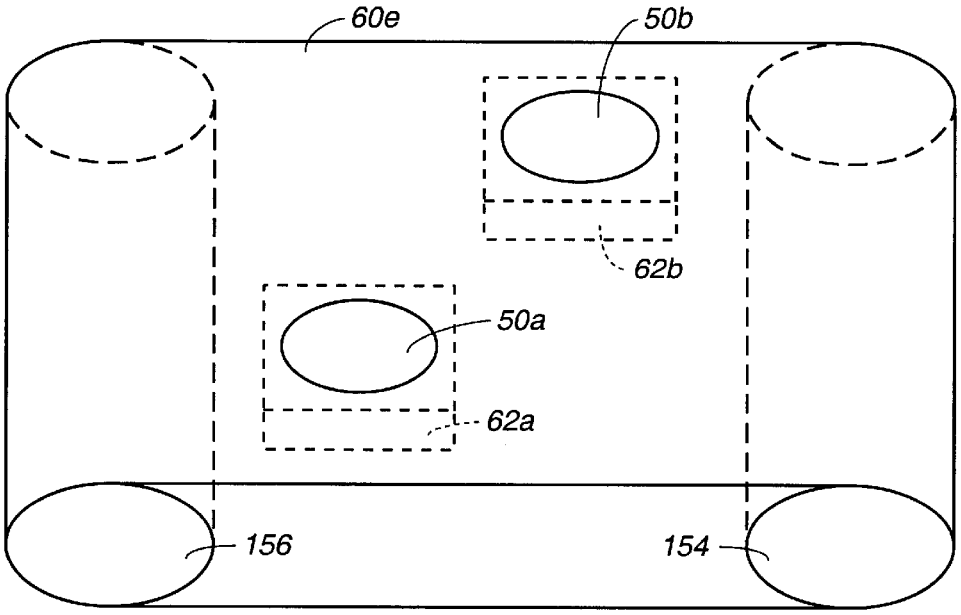
FIG._12
FIG._13
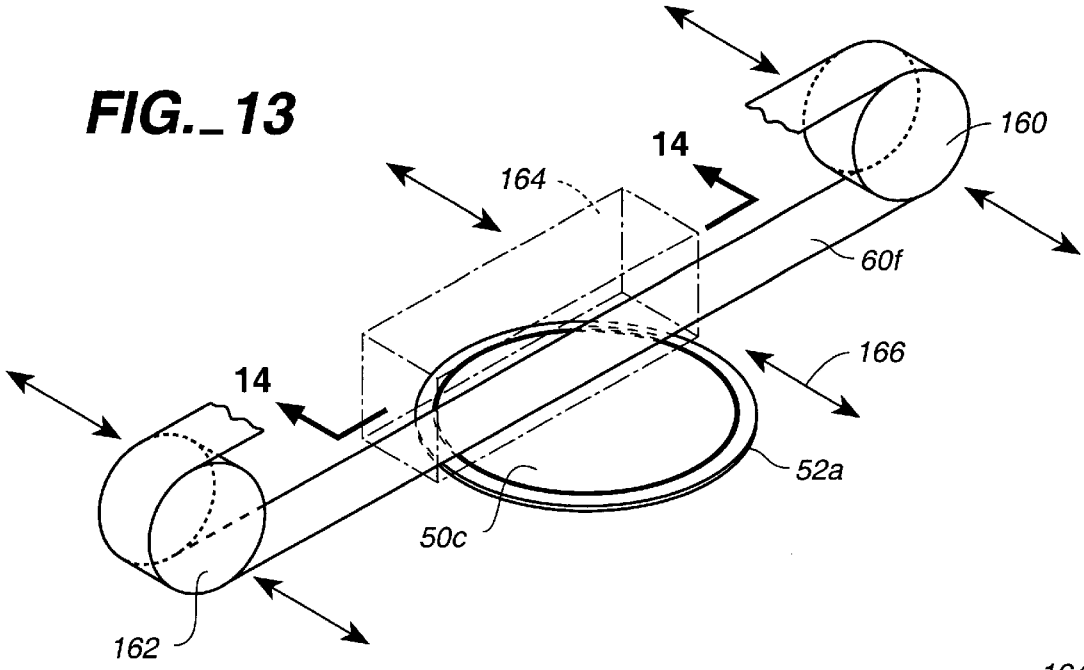
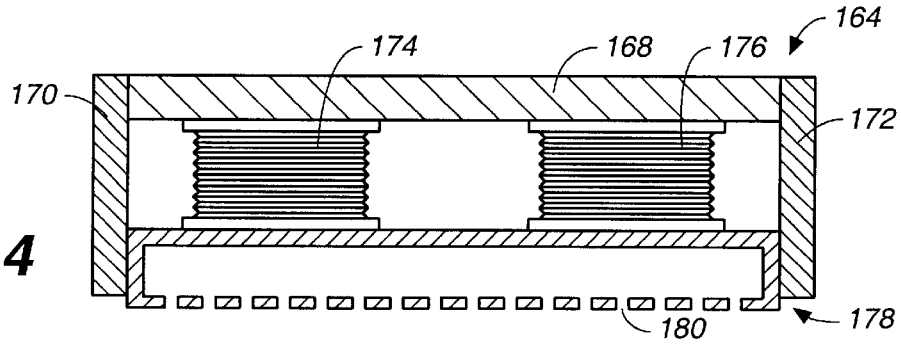
FIG._14

SUBSTRATE BELT POLISHER

The present application is a continuation of U.S. application Ser. No. 08/568,188, filed Dec. 5, 1995.

FIELD OF THE INVENTION

The present invention relates to the field of chemical mechanical polishing. More particularly the present invention relates to apparatus and methods for chemical mechanical polishing of substrates used in the manufacture of integrated circuits.

BACKGROUND OF THE INVENTION

Chemical mechanical polishing is a method of planarizing or polishing semiconductor and other types of substrates. At certain stages in the fabrication of devices on a substrate, it may become necessary to polish the surface of the substrate before further processing may be performed. One polishing process, which passes a conformable polishing pad over the surface of the substrate to perform the polishing, is commonly referred to as mechanical polishing. Mechanical polishing may also be performed with a chemically active abrasive slurry, which typically provides a higher material removal rate and a higher chemical selectivity between films of the semiconductor substrate than are possible with mechanical polishing. When a chemical slurry is used in combination with mechanical polishing, the process is commonly referred to as chemical mechanical polishing, or CMP.

Prior art CMP process typically include a massive rotating platen containing colloidal particles in an alkaline slurry solution. The substrate to be polished is held against the polishing platen by a polishing head or carrier which can be moved in an x-y direction over the plane of the platen from a position near its outside diameter to a position close to its center. The platen is several times larger than the substrate to be polished. The substrate is rotated independently while pressure is maintained between the substrate and the polishing pad.

The rate of material removal from the substrate in CMP is dependent on several factors including, among others, the chemicals and abrasives used in the slurry, the surface pressure at the polishing pad/substrate interface and the net motion between the substrate and the polishing pad. Generally, the higher the surface pressure and net motion at the regions of the substrate which contact the polishing pad, the greater the rate of removal of material from the substrate. It should be appreciated that equipment capable of performing this process is relatively massive and difficult to control to the precision necessary to consistently remove an equal amount of material on all areas of the substrate.

Using a large polishing pad of CMP processing creates several additional processing limitations which lead to non-uniformities in the polished substrate. Because the entire substrate is rotated against the polishing pad, the entire surface of the substrate is polished to a high degree of flatness as measured across the diameter of the substrate. However, where the substrate is warped, the portions of the substrate which project upwardly due to warpage tend to have higher material removal rates than the remainder of the substrate surface. Furthermore, as the polishing pad polishes the substrate, material removed from the substrate forms particulates which may become trapped in the pad, as the polishing slurry dries on the pad. When the pad becomes filled with particulates and the slurry dries in the pad, the polishing surface of the pad glazes and its polishing characteristics change. Unless the user constantly monitors the removal rate of the polishing pad with each substrate, or group of substrates, and adjusts the slurry, load, position, and/or rotational speed of the polishing pad to maintain the desired material removal rate, the amount of material removed by the polishing pad from each substrate consecutively processed thereon will decrease.

SUMMARY OF THE INVENTION

The present invention provides methods and apparatus for polishing substrates where the polishing pad is a flexible membrane strip or belt (preferably continuous) which moves linearly between adjacent support rollers to provide uniform polishing of the substrate in contact with the moving membrane. In one embodiment a flexible polishing membrane has a substrate holder (polishing head), holding a substrate for polishing on a first side of the linearly moving membrane and a membrane backing member on a second side of the linearly moving membrane. The substrate holder and the membrane backing member are collectively configured to provide a set of clamping forces to urge the substrate and the first side of said membrane into contact with one another for polishing.

In one embodiment the membrane backing member is a flat surface having generally equally distributed fluid holes therein. The holes face the back of the flexible polishing membrane such that when the membrane backing member is brought into close proximity to the flexible membrane and fluid (liquid or gas) is flowing out from the holes a fluid layer is formed between the surface of the backing member and the second side of the flexible membrane (belt). Clamping forces urging the belt and backing member together are generally uniformly resisted by the intervening fluid layer which provides a nearly uniform pressure between the membrane and backing member. The uniform pressure on the backside (second side) of the membrane is substantially transferred through the membrane to provide uniform mechanical abrasion over the surface of the substrate being polished by rubbing against the first side of the membrane. The set of forces urging the substrate and membrane against one another can be varied in conjunction with, or independently of, any adjustment in the speed at which the membrane moves relative to the substrate being polished.

Preferably the substrate is fixed in the substrate holder at a location generally closely adjacent to the path of the freely moving membrane (belt). The backing member is supported by an urging member whose force can be adjusted. In one example, the force supplied by the urging member on the backing member is provided by a bellows assembly having bellows whose internal pressure is controlled to maintain a pre-set force on the back of the membrane regardless of dimensional variations in the surface of the substrate and in the thickness of the membrane belt and any liquids or slurries on its surface.

Alternately, the backing member can be held fixed while the substrate holder and substrate can be urged by an adjustable urging member whose force can be adjusted. Similar to the urging member discussed above for the backing member, the force supplied by the urging member on the substrate member is provided by a bellows assembly having bellows whose internal pressure is controlled to maintain a pre-set force on the membrane regardless of dimensional variations.

As a third alternative, adjustable urging forces can be provided to both the substrate holder and to the membrane backing member. However the balancing of such forces would have to be controlled carefully to assure that nearly central alignment of the flexible membrane between its adjacent rollers (pulleys) is maintained.

Polishing of wafers as described above is done by a belt which is generally wider and longer than the size of a single substrate (wafer). Polishing contact takes place over the whole surface of the wafer at once, as the belt is generally in contact with the full width and length of the substrate's surface at one time. If the wafer were held stationary relative to the belt, then anomalies or imperfections in the polishing membrane (belt) would be transferred to the wafers surface. To avoid or reduce the possibility that any such anomalies would form the substrate is slowly rotated and is also oscillated from side to side to distribute the effect of any such anomalies over a larger area.

To avoid excess polishing at the edges of the substrate from the natural bowing of the flexible membrane when it is subjected to pressure from one side, a perimeter or fence ring is provided around the substrate. The perimeter ring, made of a highly abrasion resistant material such as Delrin or Ultra High Molecular Weight plastics, such as polyethylene, provide an artificial extension of the edge of the substrate. The transition between the edge of the substrate and the inside diameter of the perimeter ring is flat. The edge effect which causes additional wear at locations where the membrane bends because it is displaced from its natural course by the action of either the membrane backing member or the substrate support head, occurs only at the outer edges of the perimeter ring. The edge of the substrate is therefore insulated from edge effects by the perimeter ring which acts as a buffer.

Polishing as described herein is preferably done in a horizontal plane, but can be performed in a vertical orientation, or at any other angle where the substrate can be held for engagement and disengagement with the flexible polishing membrane.

Polishing wafer can also be done by using flexible polishing membranes which provide coverage less than the full area of the wafer. One example of such a configuration provides for a flexible polishing membrane which has a width whose dimension is less than the diameter of a substrate to be polished. The substrate is mounted in a holding fixture which faces a narrow circulating belt. The belt is moved back and forth transversely across the substrate to provide polishing of the full width of the substrate. The substrate and/or the belt rotating mechanism can be slowly rotated to further avoid the localized effect of belt anomalies or imperfections from being detected in the final finish polished substrate.

Still other polishing configurations reduce the contact area between the flexible polishing membrane and the surface of the substrate to a small fraction of the area of the surface of the wafer. A set of two or more small rollers cause a narrow belt to rotate in a belt carrier unit. The unit is then manipulated to move relative to the surface of the substrate to evenly polish each unit of area on the surface. For example when the substrate is rotating independently from the movement of the belt carrier unit, the higher surface velocity of the substrate near its circumference must be taken into account by providing a lower dwell time at the perimeter while compensating for the lower surface velocity near the center of the substrate by providing a longer dwell time for the belt carrier unit.

In another embodiment, the apparatus includes a rotating plate on which the substrate is held, and polishing arm which is located adjacent the plate and is moved across the surface of the substrate as the substrate rotates on the rotating plate. The polishing arm includes a polishing pad on the end thereof, which is preferably variably loadable against the surface of the substrate as different areas of the substrate are polished thereby. The speed of rotation of the substrate may be varied, in conjunction with, or independently of, any adjustment of the polishing pad against to control the rate of material removed by the polishing pad as it crosses the substrate. The polishing arm includes a cartridge of polishing pad material in tape form, a discrete length of which is exposed over the lower tip of the of the polishing arm to contact the substrate for polishing. The tape of polishing pad material may be moved over the polishing arm tip to continuously provide a new polishing pad surface as the substrate is processed, or may be moved to provide a discrete new section of polishing pad tape to polish each new substrate or allow the movement of the tape to move together with the arm to provide polishing. In another arm based configuration, the polishing pad may be offset from the polishing arm, and the polishing arm may be rotated over the rotating substrate to cause the polishing pad to contact the rotating substrate as the polishing pad also rotates about the axis of the polishing arm.

The mechanical abrading of the surface of a substrate being polished is performed by placing a slurry of colloidal particles on the surface of the polishing membrane to act as the agent for polishing. This slurry is messy and must be kept wet to remain fluid to avoid excessive build up of particles and the polishing anomalies that such buildups may create. Deionized water is therefore run onto the belt along with the slurry to maintain its fluid state and replenish the abrasive colloidal members. An option to a stream of de-ionized water is to run the belt (continuous flexible membrane) through a bath of fluid and/or to condition the surface of the belt by winding the path of the belt over a conditioning/idler pulley. The surface of the pulley would include a grooved surface pattern such as knurling to allow a nonuniform build-up of caked on slurry to be knocked off or distributed by the pattern (usually regular) on the surface of the conditioning idler pulley. While not presently available, a dry belt which would provide the same or a very similar abrading action would be preferred to eliminate the mess and complications associated with the use of slurry. As far as is known no dry-type continuous belts for CMP are presently available.

In CMP the chemical part of the activity is performed by providing typically an alkali (reducing) solution such as NaOH to the surface of the substrate during processing. The alkali solution causes softening of the surface of the substrate. The softened layer can then be more easily removed by the mechanically abrasive colloidal particles in the slurry. The depth of softening of the surface by the alkali solution is dependent on the time of contact between the solution and the surface. The introduction and removal of alkali solution must be carefully controlled to avoid over or under polishing the surface of the substrate. The chemical treatment provides for removal of the surface layer of the substrate to a uniform depth, rather than a strictly mechanical planarization which when planarizing substrates with high and low points takes more from high points and less from low points thereby increasing the possibility that layers of material which have been uniformly deposited over underlying undulating layers will be breached and the substrate features damaged or rendered less reliable as a result of the build up of manufacturing tolerances.

A method according to the present invention includes the nearly theoretically ideal arrangement where the surface of the substrate being processed is uniformly exposed to an abrasive agent with a uniform force between the membrane carrying the abrasive and the substrate. The method includes the method steps of: holding a substrate to be processed in close proximity to a linearly moving membrane

BRIEF DESCRIPTION OF THE DRAWINGS

FIG. 12 shows a configuration according to the invention showing two polishing locations on a polishing membrane having a width so that the processing of a substrate at one polishing location generally does not affect the polishing of a second substrate at a second polishing location, the polishing heads not being shown;

FIG. 13 shows a cut away perspective view of a partial width polishing membrane and its movement across a substrate being polished, the return side of the polishing membrane loop is cut away for clarity, the polishing head away from the substrate not being shown;

FIG. 14 shows a cross sectional view of the polishing membrane backing faceplate assembly used in FIG. 13 taken at 14—14;

DETAILED DESCRIPTION

Chemical mechanical polishing (CMP) involves polishing a substrate surface by using a chemical (e.g. an alkaline solution) to react with the surface to be polished and then abrading the surface by mechanical means. A uniform distribution of the chemical and a uniform application of the abrading agent will result in a generally smooth, but not necessarily planar surface which is compatible with subsequent substrate processing steps.

A continuous belt sanding device can contact the substrate with a spatially uniform pressure to uniformly abrade the surface to be polished. A continuous belt, subject to variations in properties across its width, provides uniform abrasion (wear pattern) across the substrate surface. Uniform abrasion is achieved when an equal net length of a polishing membrane (or belt) travels past each unit of surface area on the surface of the substrate and the abrasive media is evenly distributed on the polishing membrane. If a large width of the substrate is being swept by a single pass of the belt, then it is possible that some variation in abrasion might be detected when an abrasive track (assuming parallel imaginary tracks on a continuous belt) moves over a longer length of the substrate (for instance between its leading and trailing edges near the centerline of a circular wafer) when compared to a similar track moving over a shorter length of substrate (for instance near the edge of a circular wafer). This potentially very slight variation is explained by the fact that colloidal abrasive particles present in the slurry and become contaminated with removed material as they move across the substrate so that the belt's abrasive efficiency decreases with a longer contact surface.

Figure 1:
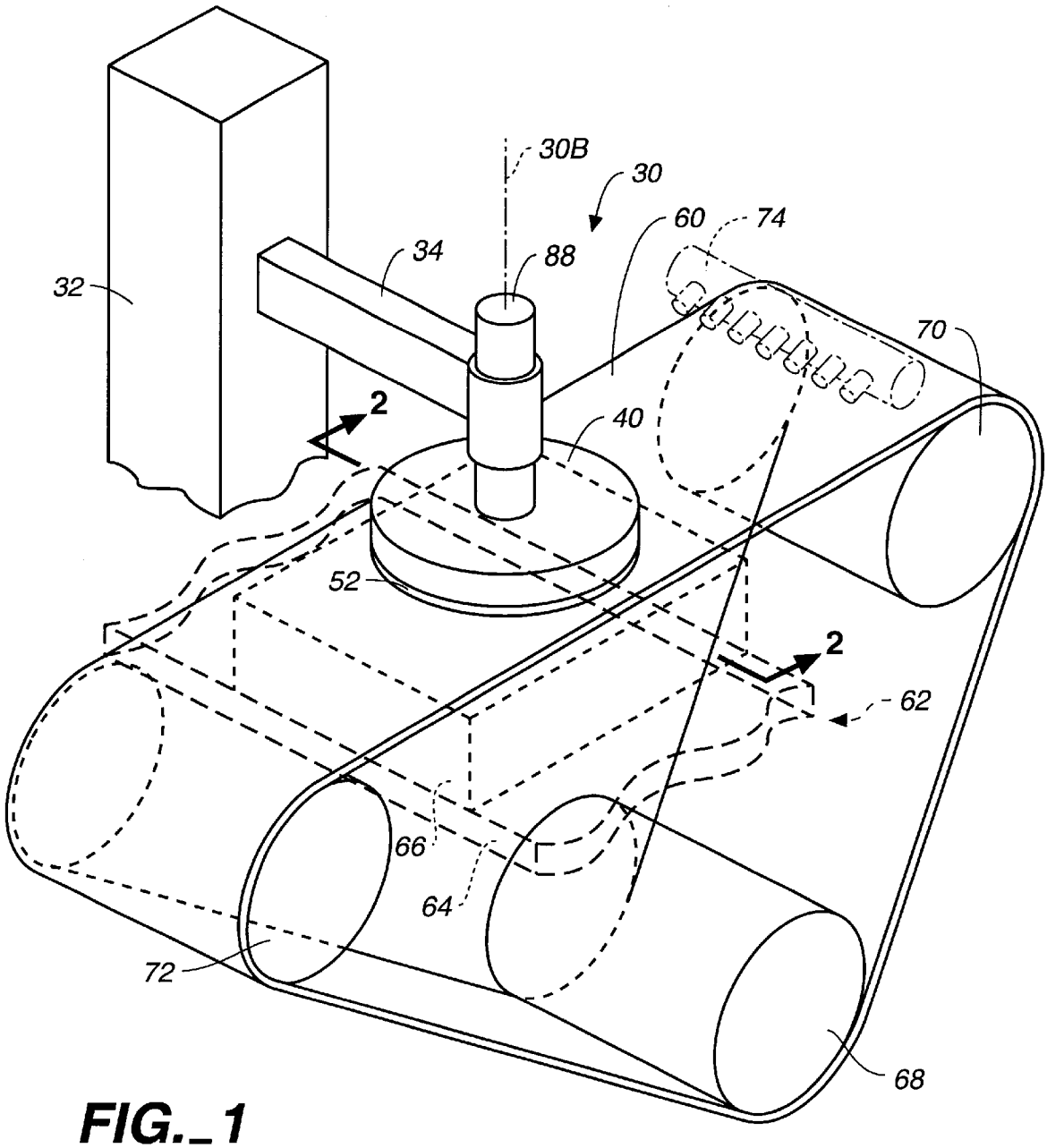
FIG. 1 is a perspective view of an embodiment according to the invention showing a continuous flexible polishing membrane (belt) wrapped on three rollers with a polishing head holding the substrate being polished on top of the membrane, a membrane backing assembly opposite the polishing head below the polishing membrane.

A configuration according to the invention executing the principle of uniform pressure over the surface of the substrate with a uniform belt contact distance across the wafer is shown in FIG. 1. The perspective view of FIG. 1 shows a configuration including a flexible membrane (polishing belt) 60 (usually an unimpregnated polyester material to which abrasive particles are added in use) routed around three rollers 68, 70, 72. A substrate (wafer) holder (polishing head) assembly 30 includes a fixed support 32 connected to a cantilevered arm 34. The cantilevered arm 34, as shown in FIG. 1, rigidly supports a polishing head shaft 38 which can be rotated by a rotation mechanism (not shown) and whose vertical motion can be adjusted by a vertical adjustment mechanism (not shown). Alternatively, the fixed support 32 can include hinged or pivoting features to raise or pivot the polishing head assembly 30 so that the substrate 50 being polished (not shown in FIG. 1 as it is on the underside of the polishing head assembly 30) can be loaded and unloaded to access polishing operations on the belt 60.

The flexible polishing membrane 60 moves in a right to left longitudinal direction between the top two rollers, i.e. from roller 70 to roller 72. As the flexible membrane (belt) 60 moves, an abrasive slurry containing colloidal abrasive particles of $SiO_2$ is distributed over the width of the belt 60 by a slurry distribution manifold 74. Abrasive slurry is thereby placed on the flexible membrane 60 as it moves towards the polishing head 30. As the abrasive slurry on the polishing membrane 30 contacts the substrate held by the polishing head 30, mechanical abrasion polishing of the substrate occurs. The chemical, e.g., NaOH, used to control the polishing rate can be part of the slurry or can be applied to the polishing membrane and substrate at another location in the cycle of the belt, e.g., by using spray nozzles (not shown).

It is important to provide an uniform belt pressure across the surface area of the substrate being polished. It is generally not sufficient to place the polishing head 30 against a belt 60 and rely only on the tension of the belt 60 between rollers 70 and 72 to assure uniform polishing of the substrate surface. Instead, a flexible membrane backing assembly 62 (shown in dashed lines in FIG. 1) is provided at a location adjacent to the belt 60 directly opposite to the polishing head 30 on top of the belt. The moving belt is sandwiched between the head 30 and the membrane backing assembly 62. The backing assembly 62, when in contact with the belt, assists in providing a uniform contact pressure between the belt 60 and the substrate 50.

The membrane backing assembly 62 includes a fixed support member (membrane backing support bridge) 64 and a generally flat-topped membrane backing faceplate assembly 66. The membrane backing faceplate assembly 66 provides a uniform pressure to the underside of the moving belt 60 so that a uniform abrading pressure is applied over the surface of the substrate by uniformly pressing the polishing belt 60 upwards, with a small or negligible displacement, toward the fixed polishing head 30 which is located immediately adjacent to the path of the continuous belt 60.

Figure 2:
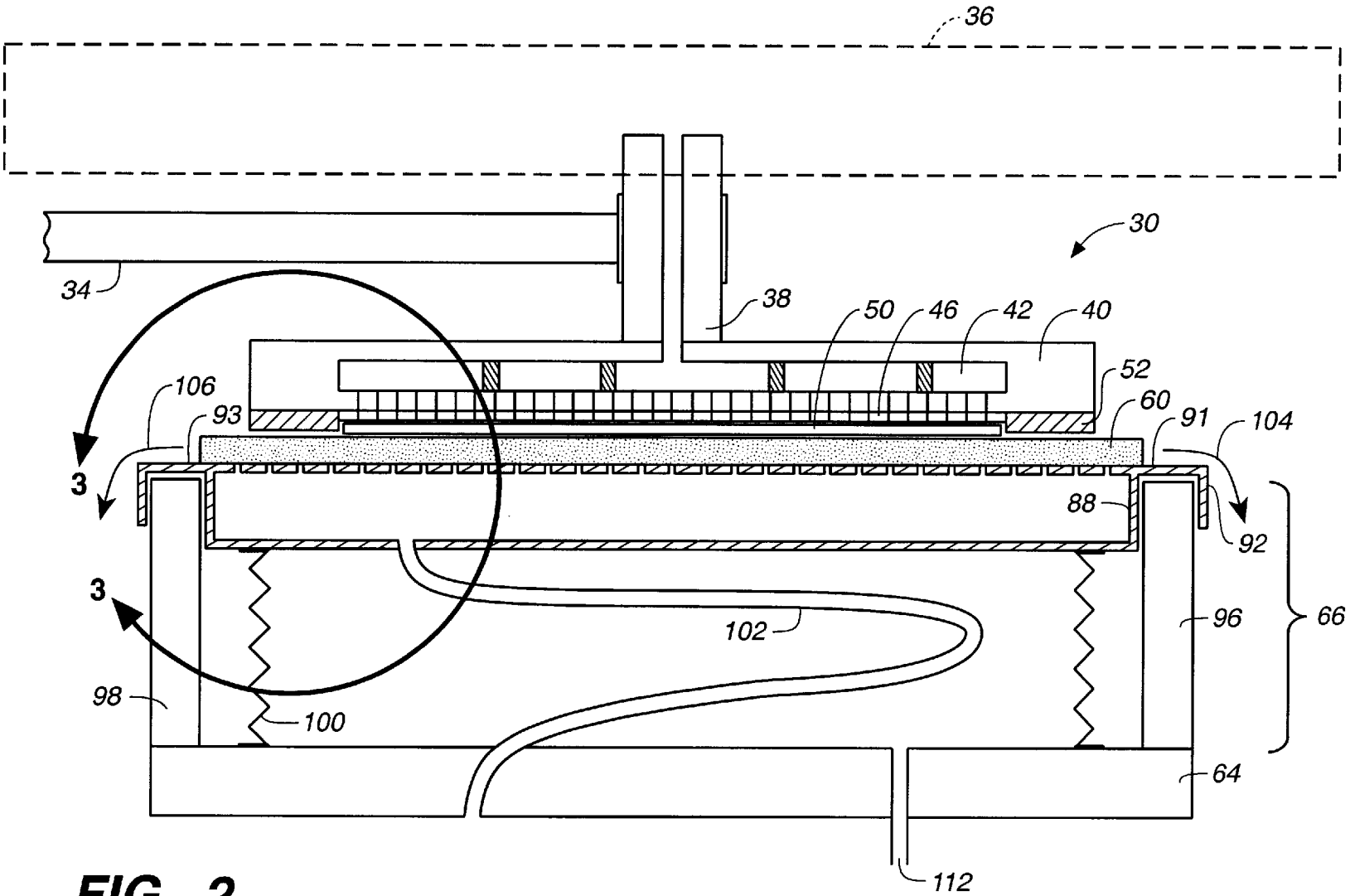
FIG. 2 is a cross section of FIG. 1 taken at 2—2 showing the internal configuration of the polishing head and the polishing membrane backing assembly.
Figure 3:
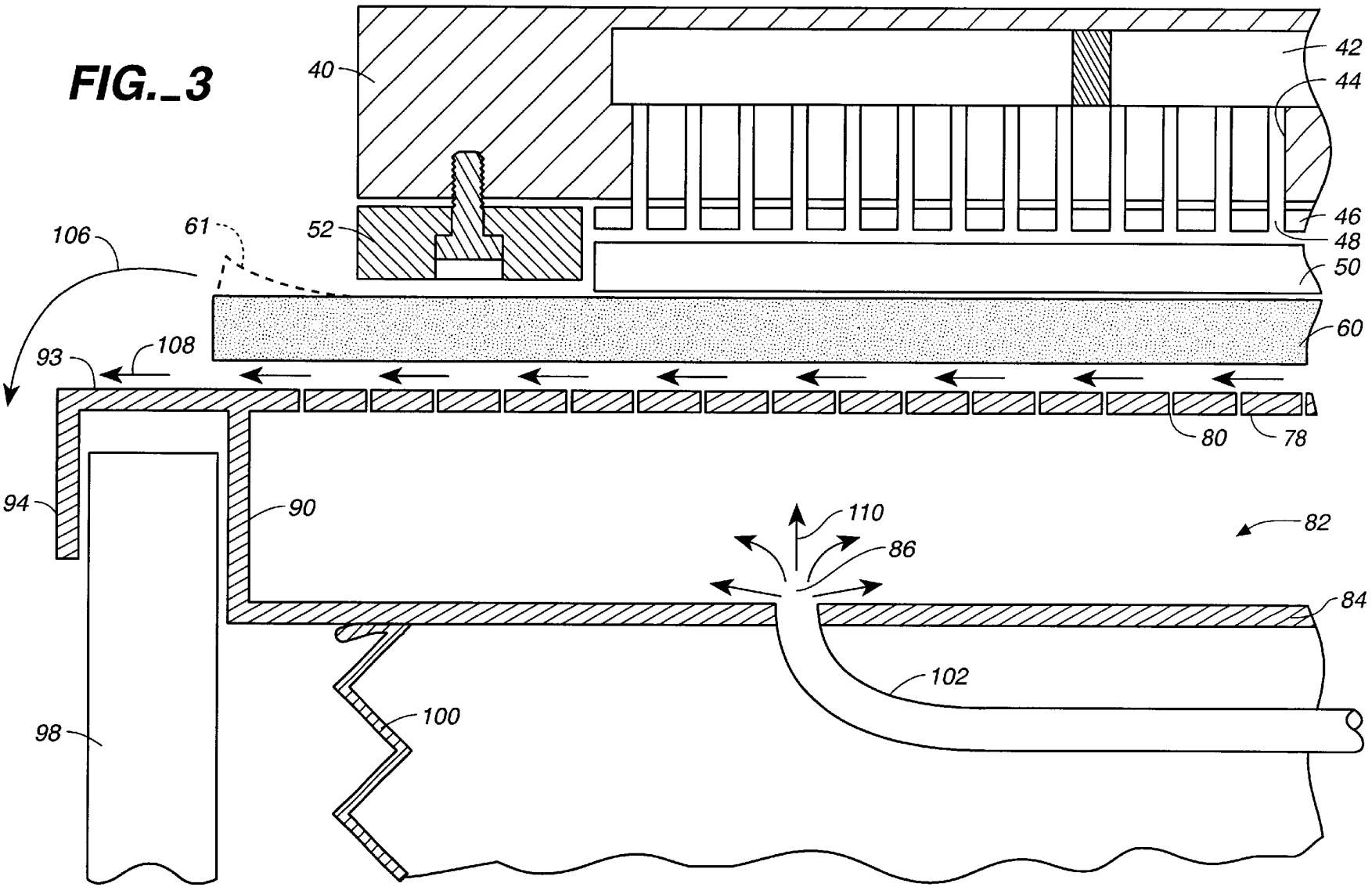
FIG. 3 is a close-up view of FIG. 2 taken at 3—3.
Figure 4:
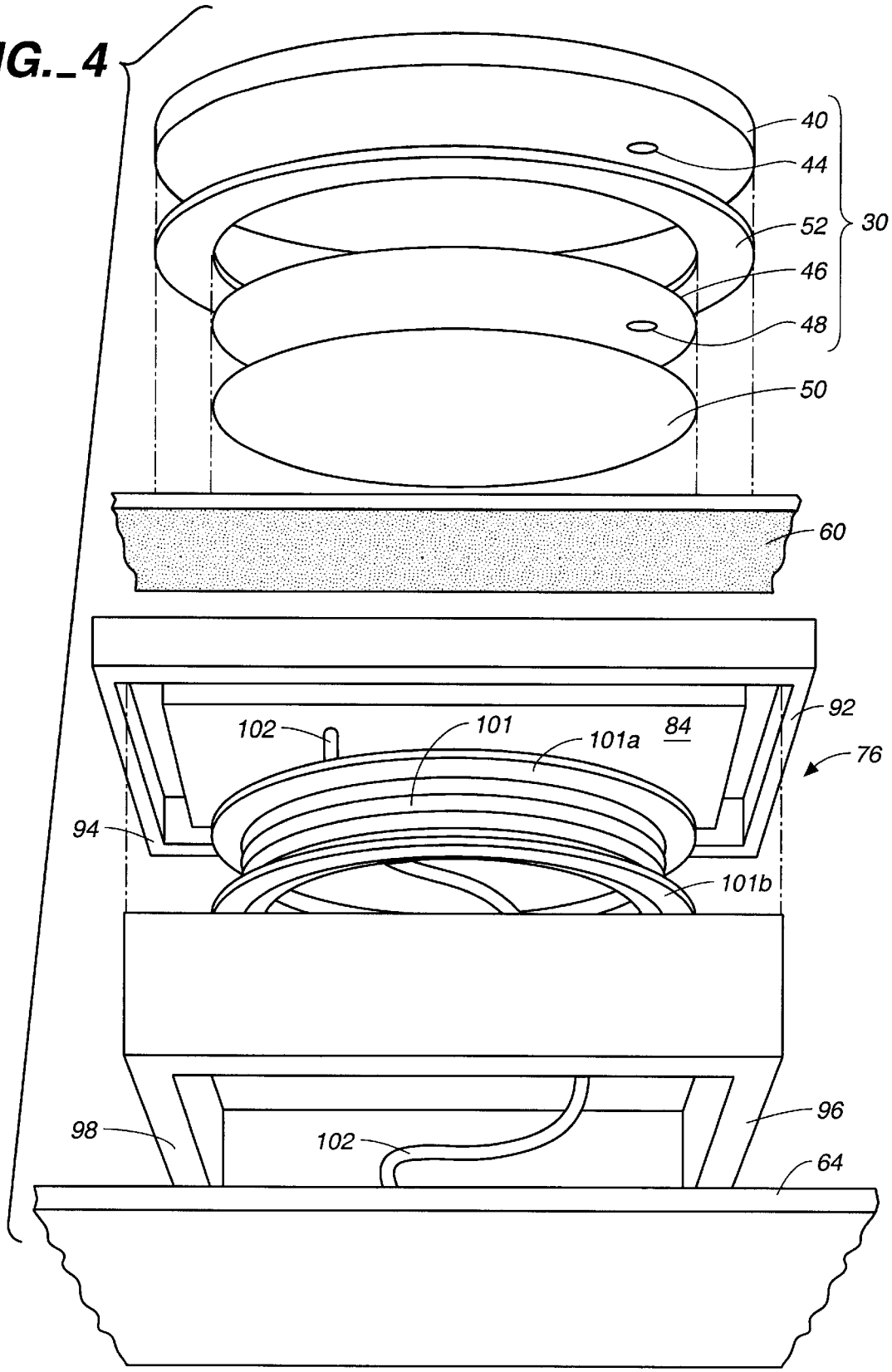
FIG. 4 shows an exploded view of the polishing head assembly and the polishing membrane backing assembly, according to the invention, in relation to the polishing membrane.
Figure 5:
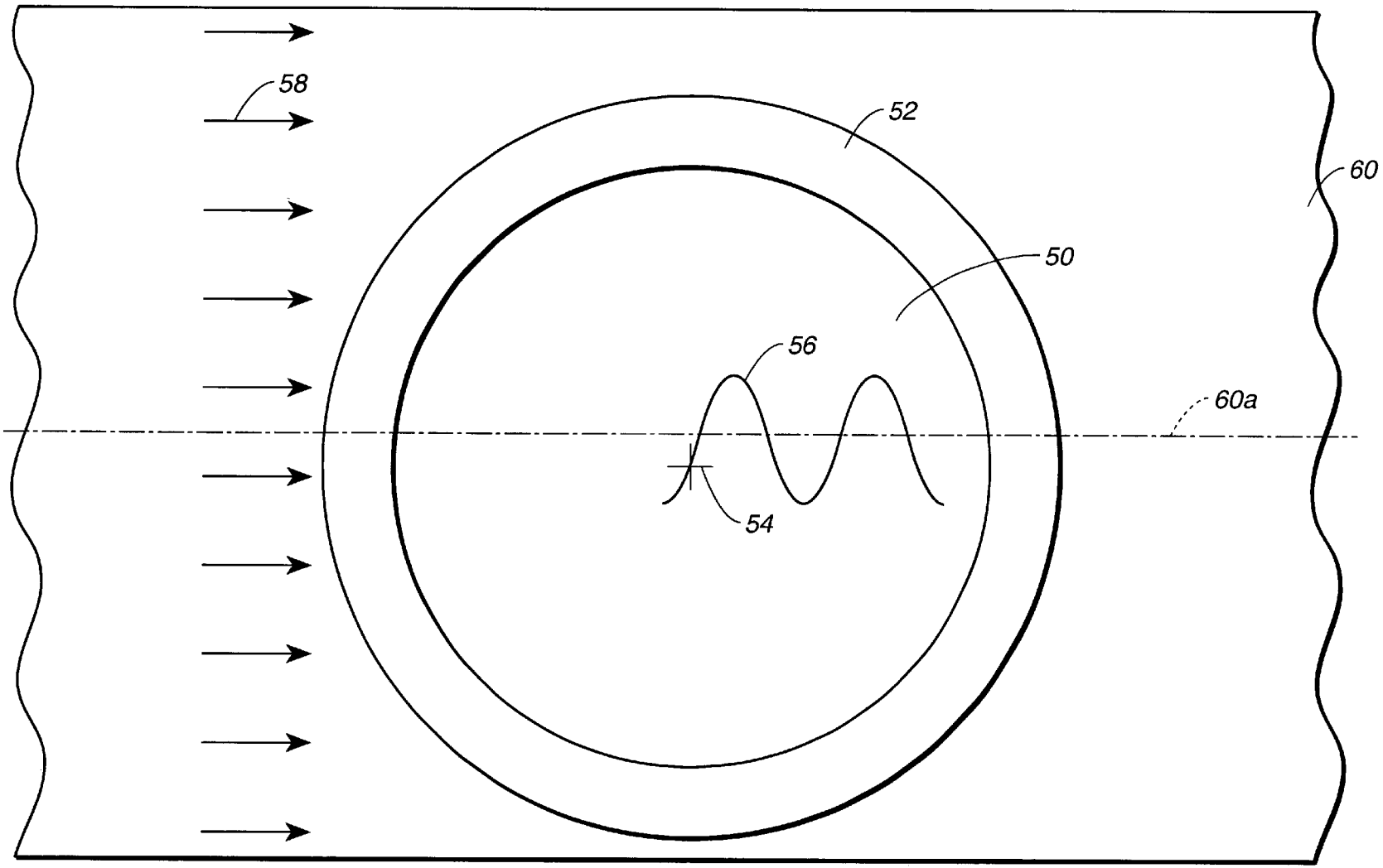
FIG. 5 shows a schematic top view of the polishing membrane at its interface with the polishing membrane as shown in FIGS. 1–4.

A cross section of the substrate polishing location as shown in FIG. 1 is shown in FIGS. 2 and 3. FIG. 3 is a closeup view of the configuration around one side of the polishing membrane 30. FIG. 4 shows a perspective exploded view of the details of the polishing head 30 and the membrane backing assembly 62. The polishing head 30 is supported by a lateral cantilever support 34. A continuous upper bridge support 36 shown in FIG. 2 presents an example of an alternate support scheme for the polishing head (also shown for example by the bridge support 186 in FIG. 15). In either of these configurations, although not shown in the Figures, the substrate 50 and polishing head 30 may be rotated by a rotating mechanism. The substrate 50 and polishing head 30 can also be oscillated laterally (up and down as shown in FIG. 5) across the width of the belt 60. Such rotation and oscillatory movement prevents any surface defect or anomaly in the polishing belt 60 from creating a corresponding anomaly the surface of the substrate 50 being polished. Slow rotation of the polishing head 30 (providing a diametral speed which is less than 1/100th of the translational speed of the belt 60) distributes the action of a defect on the surface of the belt over the surface of the substrate to help minimize its effect. If the polishing head moves at a rate of 100 ft/min then the rotation of the polishing head for an eight inch wafer should be about 1 rpm or provide a 100:1 ratio between the movement of the belt versus the movement related to the rotation of the substrate. Under these conditions, belt or backing assembly defects located far from the center of a stationary rotating substrate are well distributed, while those which are closer to the center of the substrate are less well distributed. If a defect were to be located at the center of the substrate, rotation alone would cause no distribution of the defect. Therefore, to avoid the deleterious effects of such defects, the polishing head 30 is oscillated from side to side in an oscillatory motion. To prevent the polishing head 30 from coming off the belt 60 during such sideways oscillation, the belt 60 is wider than the polishing head 30 by a dimension at least equal to the full amplitude of the oscillation. This necessitates that the membrane backing assembly 62 also be wide enough or move together with the polishing head 30 to maintain uniform pressure on the bottom of the belt 60 opposite the polishing head throughout the extremes of sideways oscillatory travel. In the configuration as shown in FIGS. 1–6, the polishing belt 60 and membrane backing assembly are wider than the substrate 50.

Increased abrasion at the edge of the substrate (edge effects) can result from bowing of the flexible membrane outside the area clamped between the polishing head 30 and the membrane backing assembly 62. Edge effects can also result from the perimeter (edge) having to ride over or break down (cause distribution of) areas where slurry and/or the colloidal abrasive particles have built up and are not evenly distributed. It is preferable to eliminate the possibility of such edge effects. The configurations of FIGS. 1–6 include a retaining (edge—surface conditioning) ring 52. The retaining ring 52 surrounds the substrate 50 and prevents it from sliding out from under the polishing head 30. The retaining ring 52 and substrate are collectively held (or in other configurations pressed) against the moving belt 60. The thickness of the retaining ring 52 is generally equal to the thickness of the substrate being polished 50 together with any backing pad (e.g., item 46 in FIGS. 2–4). The retaining ring 52 is attached to the bottom of a main polishing head member 40 so that pressure on the polishing head 50 is uniformly distributed to both the substrate 50 and the retaining ring 52. The presence of a retaining ring 52 requires that a larger diameter polishing head 30 be used. This in turn requires that the width of the polishing membrane 60 also be increased to prevent any part of the head 30 from coming off the polishing belt 60 during sideways oscillatory motion. The substrate retaining ring 52 is attached to the holding assembly backing plate by screws or generally mechanical holding mechanisms. The ring 52 can be released and replaced when the wear is excessive.

The polishing head 30 includes a vacuum manifold 42 to distribute vacuum to vacuum holes 44 in the bottom of the main head member 40. The vacuum supply to the vacuum manifold 42 is through the polishing head shaft 38 to a rotatable coupling at the top of the shaft (not shown). The pattern of vacuum holes 44 on the bottom side of the main head member 40 partially or fully matches (a partial match utilizes some of the holes to retain the elastomer pad against the main head member) a pattern of holes 48 in the substrate backing pad 46 (preferably an elastomeric pad) to provide a conformable surface which can help to seal the vacuum passages against the substrate 50 during substrate loading and unloading operations and against which the substrate 50 can be pressed for polishing. Other arrangements for holding the wafer utilizing an elastomeric pad may be provided. They include placing an elastomer without holes across larger holes in the main head member 40. Pulling a vacuum partially pulls the elastomer into the larger holes and creates inverted craters in the elastomer, which when in contact with a wafer, act as suction cups to hold the wafer. When vacuum is pulled in the vacuum manifold 42, the substrate is held to the bottom surface of the polishing head 30 inside a cavity formed by the retaining ring 52. Vacuum pressure to the vacuum manifold 42 is controlled to allow loading and unloading of the substrate from the polishing head when the polishing head 30 is shifted to the loading or unloading position (for example as shown by dashed lines 30*a* and 34*a* in FIG. 6). These vacuum passages can also be pressurized to assist in release of the substrate 50 from the polishing head 30 or in other configurations to assist in pressing the substrate uniformly toward the moving belt.

The membrane backing assembly 62 faces the underside of the polishing membrane 60. The top surface of the assembly 62 is generally square or rectangular and is located to oppose the polishing head 30, so that the moving polishing belt is clamped between the two. The membrane backing assembly 62 includes the horizontally extending fixed support member (bridge) 64 supporting a vertically extending fixed support frame (a perimeter wall—forming an open box) consisting of a series of sidewalls, e.g. 96, 98, over which a generally horizontally extending faceplate 76 floats. The faceplate 76 is allowed to float vertically, but is retained horizontally, by the fixed sidewalls, e.g., 96,98. The sidewalls, e.g., 96,98 can be seen in FIGS. 2 and 4. An extendible bellows 100 flexibly connects the membrane backing support 64 to the floating faceplate 76. The bellows 100 can be pressurized to a fixed pressure or the pressure within the bellows can be controlled to provide a pre-set variable or pre-set constant vertical force (as seen in FIGS. 2 and 3) on the bottom of the moving flexible membrane (belt) 60.

A rubbing plate (not shown), commonly used in belt sanders, can be molded over the top of the floating faceplate 76 to provide a flat surface against which generally uniform rubbing can take place. The faceplate 76 with a top surface in contact and rubbing against the bottom of the flexible polishing membrane 60 wears both elements over time and either the membrane or the top of the backing plate would have to be replaced periodically. Many defects in the surface of the backing plate present at installation or which form later would tend to displace the flexible membrane unevenly and tend to cause uneven wear on the surface of the substrate being polished. To eliminate this wear between the bottom of the flexible membrane 60 and the top of the face 78 of the floating faceplate 76, a pressurized fluid of either gas or liquid is provided through the holes 80 of the faceplate 76 and provides a uniform fluid bed or film of gas or liquid which acts as a nearly friction free buffer between the back of the flexible membrane 60 and the upper surface of the floating backing faceplate 76. The passage of fluid at the surface holes of the floating backing plate member provide a generally uniformly pressurized fluid layer between the back of the membrane and top of the backing plate assembly which therefore evenly pressurizes the back of the moving flexible membrane 60. The fluid or gas creating this layer is continuously replenished so that the thickness of the layer remains generally constant as the liquid or gas escapes sideways.

A set of small fluid holes 80 in the top of the faceplate membrane surface 78 provide for fluid (gas or liquid) passage from the faceplate fluid manifold cavity 82 to its surface 78 in contact with the moving belt 60. The fluid layer (illustrated by arrows 108 showing fluid flow) is thereby created between the moving polishing belt 60 and top surface 78 of the faceplate 76. The fluid can be either a gas or a liquid. The need to re-capture expended liquid weighs in favor of using a compressible gas. However, the containment used to capture the slurry could also be used to capture a liquid used in producing the fluid layer on the faceplate.

Fluid, either gas or liquid, is provided to the faceplate manifold 82 through a flexible hose 102 which is routed through the bellows 101 (or could be routed outside the bellows) such that fluid reaching the manifold enters a fluid feed opening 86 and is distributed within the manifold 82 as shown by the arrows 110. The bellows top flange 101*a* (FIG. 4) is fixed to and sealed against the faceplate back surface 84. Faceplate side surfaces 88, 90 face adjacent fixed sidewalls 96, 98 to prevent the faceplate 76 from being displaced sideways.

Since liquid slurry is present on the top of the flexible membrane (belt), it is important that the area around the bellows does not become plugged. Therefore, a labyrinth-type vertically moving skirt seal 92, 93, 94 is provided around the edge of the floating faceplate 76 to prevent any liquid, such as the slurry or pressurized liquid flowing from faceplate fluid holes 80, from flowing into the box-like container inside the sidewalls 96, 98 and restricting the vertical motion of the bellows 100.

The sidewalls of the box-shaped member enclosing the bellows also act as a guide to prevent sideways motion of the floating member backing plate. The friction generated when the floating piece rubs against the stationary piece can adversely affect the uniformity of polishing. The two surfaces can be coated with a friction reducing coating (such as PTFE). Alternately, the two surfaces may be separated by using a fluid passing nozzle configuration which interposes a fluid layer between the floating and stationary pieces. These configurations easily accommodate variations in the thickness of the slurry or the thickness of the belt 60 as the belt moves over the substrate being polished to enhance the ability of the membrane backing assembly 62 to move very rapidly according to the instantaneously encountered dimension.

Since the floating faceplate 76 is facing the moving belt 60, the belt 60 tends to pull the floating faceplate 76 in the direction that the belt is moving. The moving belt 60 will also have a hydrodynamic (aerodynamic) effect in that the fluid at the leading edge of the floating membrane backing plate will tend to be sucked away and cause the belt 60 to touch the faceplate 76 at its leading edge. The hydrodynamic effect can be compensated for by adding fluid holes at the leading edge of this interface. Alternately, a curved transition could be provided so that the belt 60 sucks enough air towards the fluid layer that undesirable touching does not occur.

The leading edge of the floating faceplate 76 can also be slightly rounded to avoid excessive wear that might be experienced as a result of the membrane catching on a sharp corner of such a leading edge.

The size and number of fluid holes 80 ideally should provide a bed or film of fluid behind the polishing membrane so that the substrate 50 is evenly and uniformly polished. The pattern of holes 80 in the rectangular floating faceplate 76 covers nearly the full width of the belt. However, when unopposed by a polishing head 30 the moving belt 60 tends to bow up as shown by the dashed lines 61 in FIG. 3.

Figure 7:
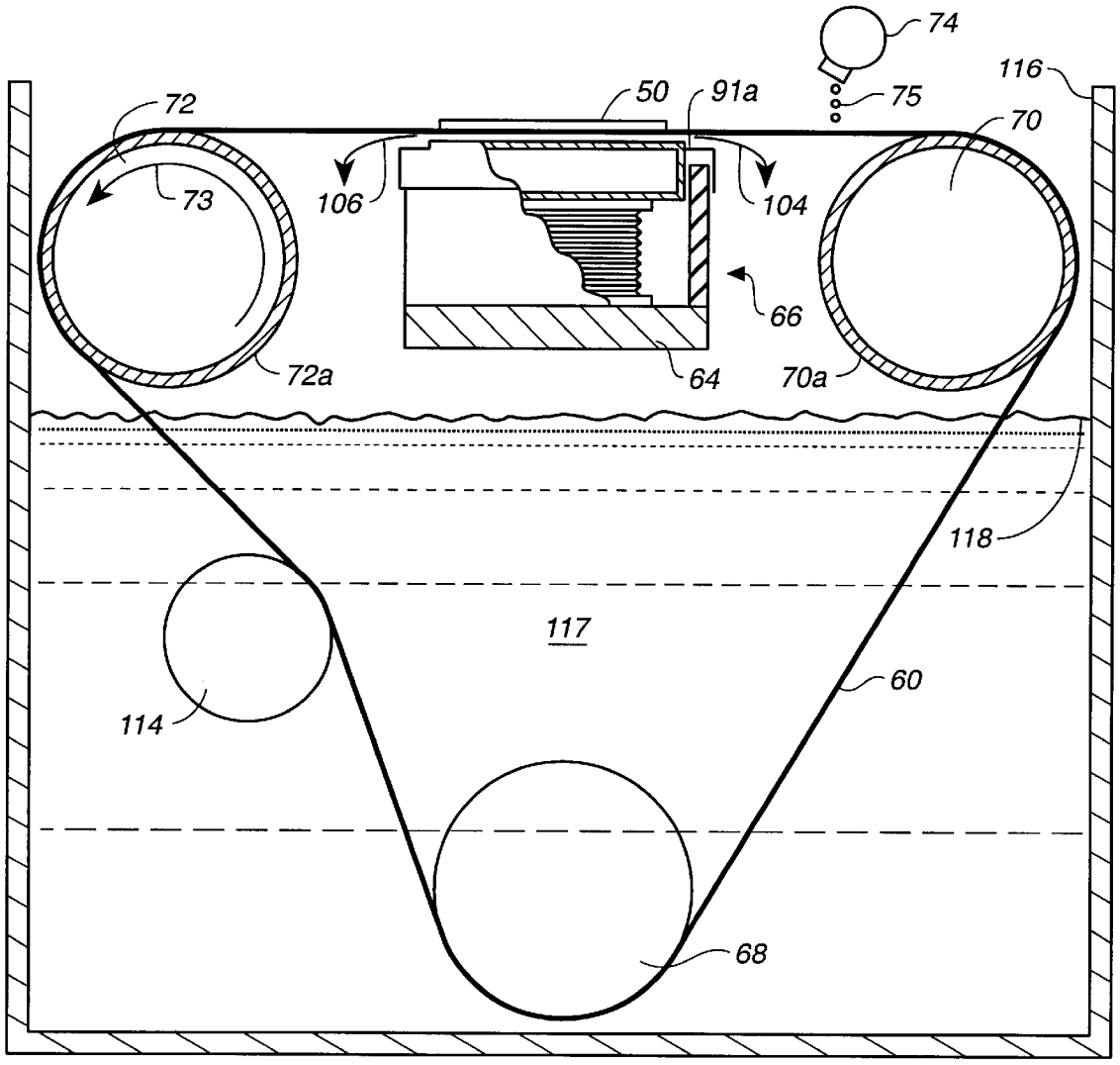
FIG. 7 is an elevation view of a configuration according to the invention showing the substrate being polished at a polishing location between two rollers on top of the polishing membrane, the polishing head not being shown and the flexible membrane circulating through a vessel partially filled with a rinse solution to assist in conditioning the polishing surface of the membrane being polished.

The floating faceplate 76 as shown in FIGS. 2 and 3 can either have a labyrinth skirt seal extension (e.g., 91, 93) whose top surface is planar with the top surface 78 of the faceplate 76 or can be offset slightly (e.g. 91*a*) as shown in FIG. 7.

FIG. 4 shows an exploded view of the items discussed above for FIGS. 1–3. The polishing head main member 40 has a series of holes 44 on its lower surface. A retaining ring 52, preferably made of Delrin, surrounds the bottom edge of the polishing head main member 40. A flexible elastomer backing pad 46 has holes 48 whose locations correspond to the holes 44 in the polishing pad main member. The backing pad 46 is placed in the cavity at the bottom of the polishing head and acts as a compliant member to the extreme local pressures that would be present if a hard metal surface pressed a silicon substrate against an abrasive medium. The substrate 50 is then sandwiched between the flexible membrane 60 and the bottom of the polishing head assembly 30 (including, but not limited to items 40, 52, 46 and 48). On the bottom of the moving flexible membrane 60, the faceplate 76 is supported by bellows 100 attached by flanges 101*a*, 101*b* and held in a particular alignment with the bottom of the moving polishing belt 60 by a perimeter wall including sidewalls 96, 98. The perimeter wall sits on support member 64.

A schematic top view of the substrate 50 and its retaining ring 52 are shown in FIG. 5. Arrows 58 show the direction of travel of the moving belt 60. The wave pattern 56 around the centerline 60*a* of the moving membrane 60 shows the oscillating action of the center 54 of the substrate retaining ring assembly (which also correlates to the centerlines of the polishing head assembly).

Figure 6:
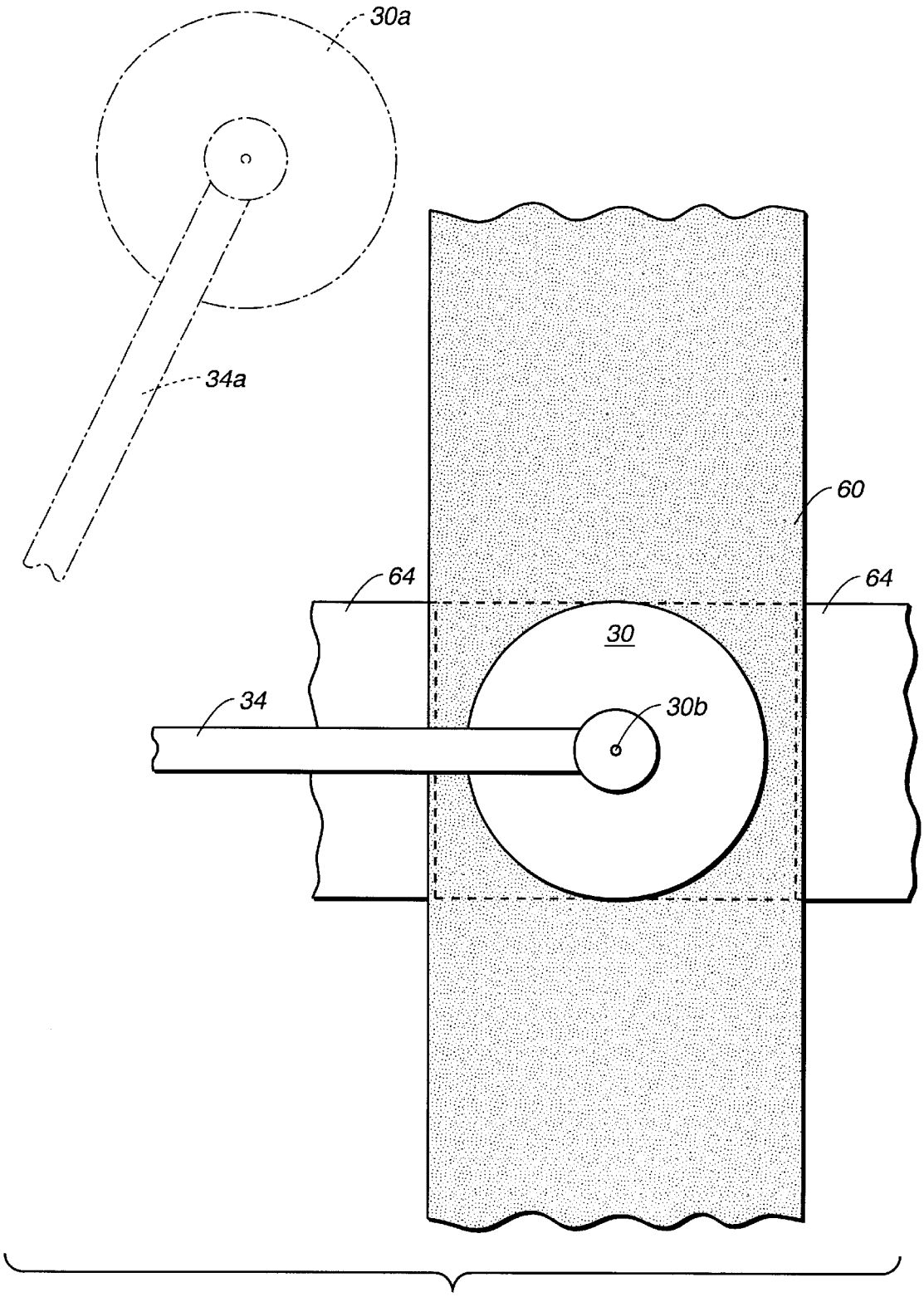
FIG. 6 shows a top view of FIG. 1.

A top view of the configuration of FIGS. 1–4 is shown in FIG. 6. While the polishing head 30 and the cantilevered arm 34 appear to show a fixed orientation in FIGS. 1–4, loading and unloading of the polishing head must generally take place by moving the belt 60 relative the polishing head 30. The dashed lines 30*a*, 34*a* in FIG. 6 show one example of such a location for loading and unloading of a substrate from the polishing head 30. While not shown in the drawings, as discussed above, the polishing head 30 can be configured to rotate about its own axis 30*b* and the cantilevered arm 34 may oscillate across the polishing belt 30.

FIG. 7 is a configuration according to the invention showing in which the polishing head 30 would be positioned against a substrate 50. A three roller 68, 70, 72 arrangement is provided around which the flexible membrane 60 is wound. A tensioning roller 114 is provided which can also act as a surface conditioner for the polishing surface of the flexible polishing membrane 60. The tensioning/conditioning roller 114 (for example, made of a ceramic or a hard plastic material to avoid contaminating the substrate 50 being polished by introducing conductive or abrasive contaminants) may have a knurled pattern in its surface to actively displace and distribute colloidal particles of slurry which have become aggregated on and attached themselves to the flexible moving membrane 60. As shown in FIG. 7, a slurry introduced by droplets 75 is distributed over the width of the moving belt 60 by a manifold 74 situated upstream from the substrate 50 being polished. The membrane backing faceplate assembly 66 is situated opposite the substrate 50 being polished. The polishing membrane 60 is routed through a bath 117 of liquid having a liquid level 118, such as de-ionized water or an alkaline solution, to assist in maintaining moisture on the belt. The small arrows 104, 106 (also seen in FIGS. 2 and 3) show fluid (such as slurry) escaping from the surface of the belt 60. The take-up roller 70 and drive roller 72 (identified by the drive arrow 73) include surface linings 70*a* and 72*a*, respectively, on their surface. These linings are made of elastomers such as neoprene and rubber or other material generally used in the art.

Figure 8:
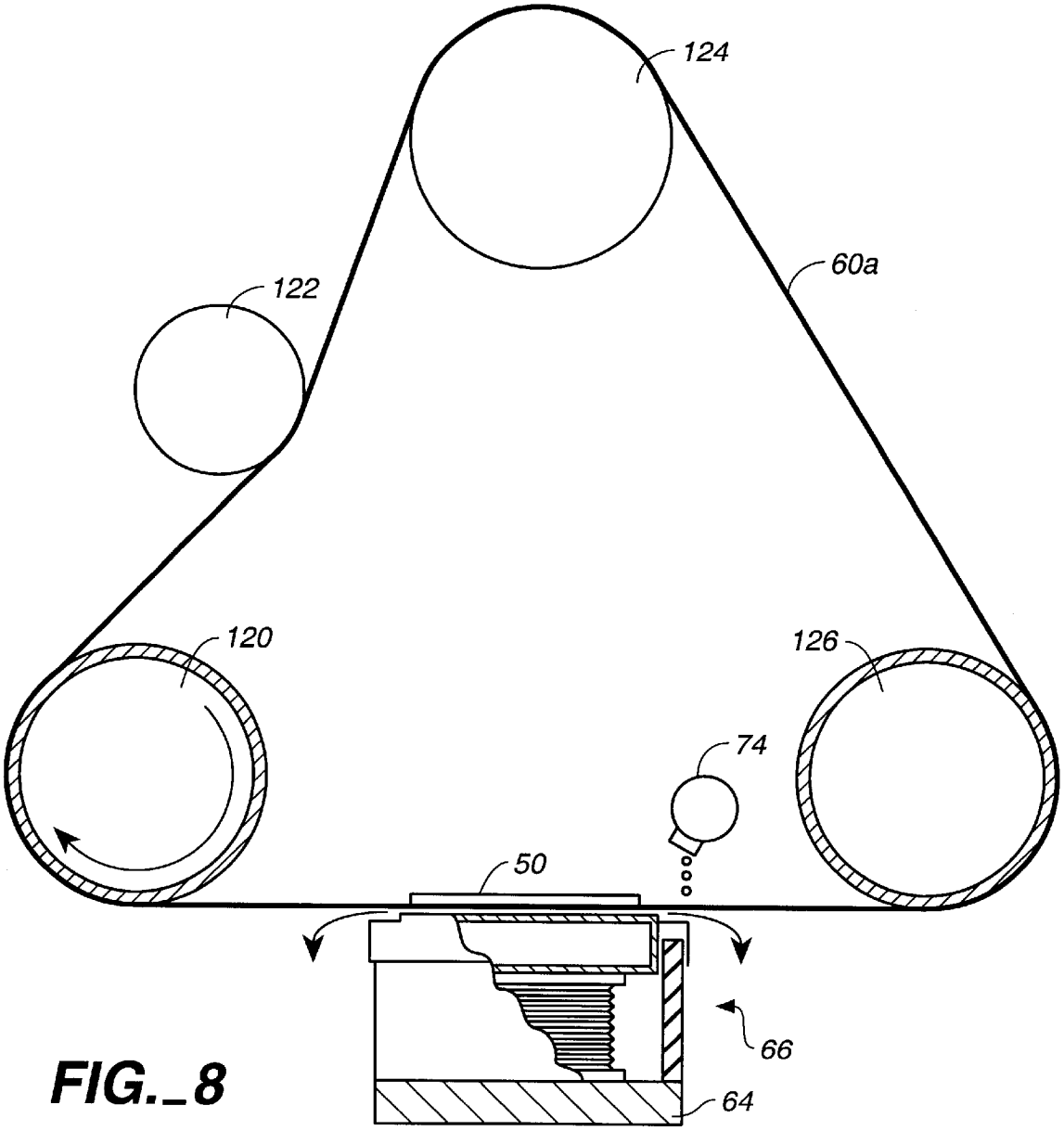
FIG. 8 shows a configuration according to the invention showing the polishing location at the bottom side of a set of three membrane rollers with the substrate on the inner surface of the polishing membrane, the polishing head not being shown.

FIG. 8 shows another orientation according to the invention. The location of the substrate 50 alone represents the location of the polishing head 30 (which is not shown) on the inside of the belt 60. In this configuration the substrate is shown and polishing occurs on the inside surface of the moving belt 60*a*. The three rollers 120, 124, and 126 and a tensioning roller 122 are located so that the actual drive 120 and guide rollers 124, 126 condition the surface of the belt 60*a* which is the polishing the wafer while new colloidal particles to abrade the substrate are added by the manifold 74. The membrane backing faceplate assembly 66 in this configuration is located below the belt 60*a*.

Figure 9:
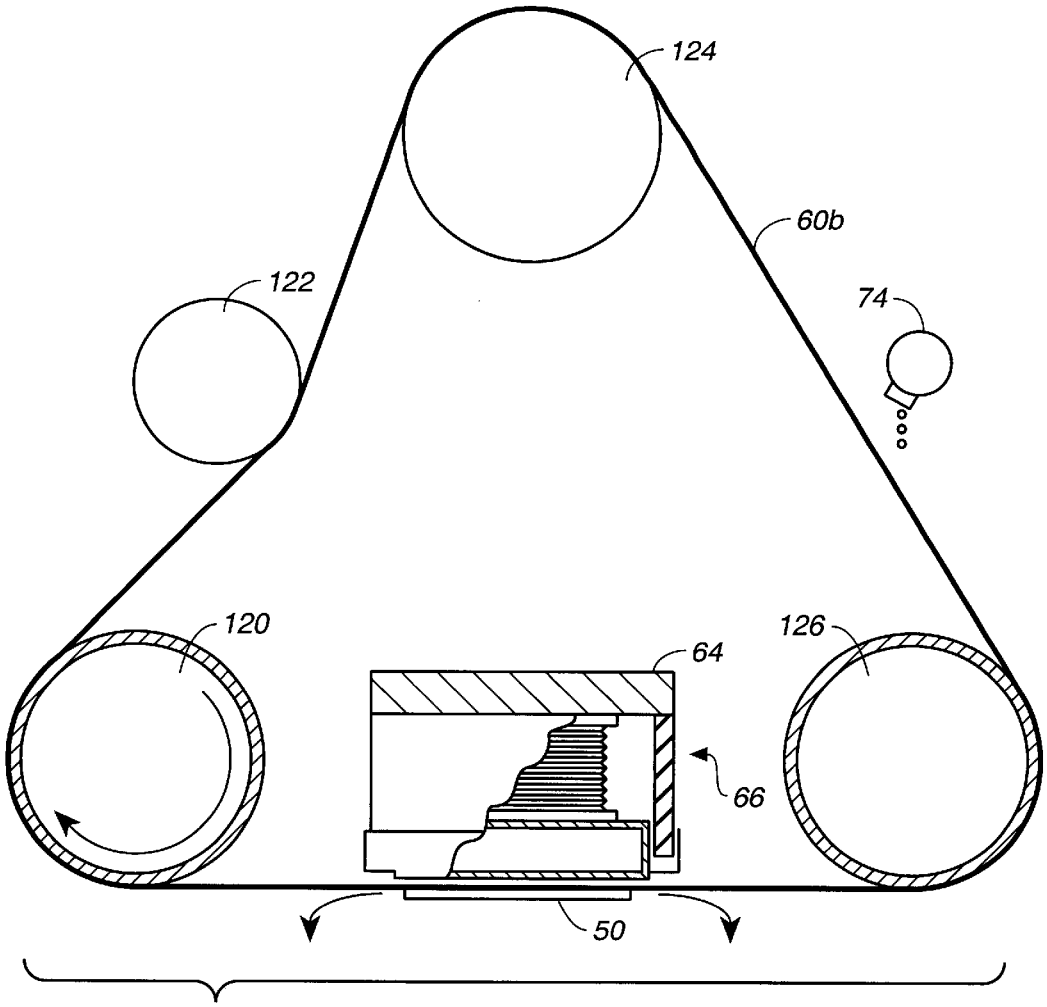
FIG. 9 shows a configuration according to the invention showing the polishing location at the bottom side of a set of three membrane rollers with the substrate on bottom of the polishing membrane, the polishing head not being shown.

FIG. 9 shows the orientation of rollers as shown in FIG. 8, but the membrane backing assembly 66 pressurizing the belt is shown above the belt and the tensioning roller 122 acts as conditioning roller in this instance. New droplets of colloidal slurry are added in this configuration to the surface of the moving belt 60*b* as the moves down the right hand path between rollers 124 and 126

Figure 10:
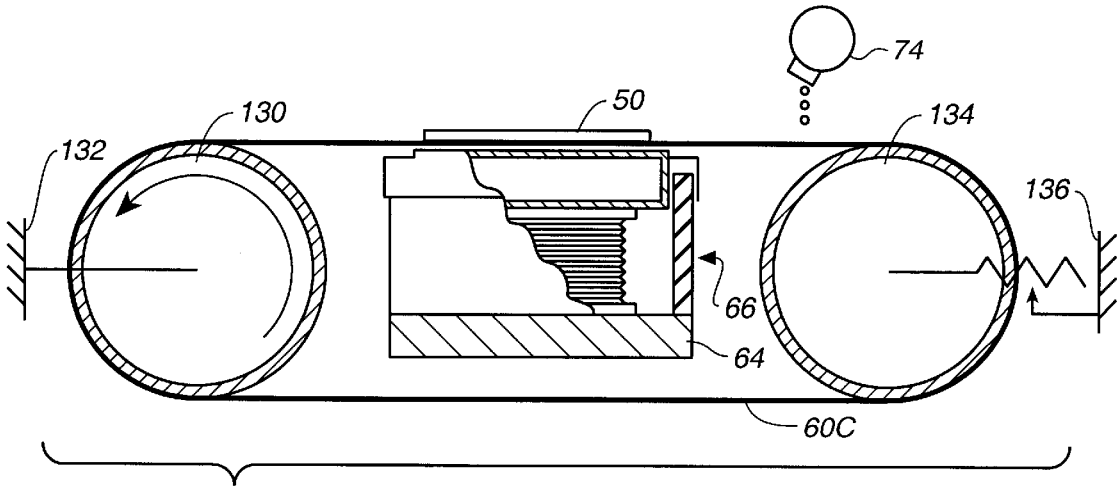
FIG. 10 shows a configuration according to the invention showing the polishing location on the top side of a set of two membrane rollers with the substrate on top of the polishing membrane, the polishing head not being shown.

FIG. 10 shows an alternative arrangement in which a moving belt 60*c* circulates around two rollers 130, 134. The substrate polishing position is shown by the location of substrate 50. The membrane backing faceplate assembly 66 is shown with variable tensioning 136 of the belt 60*c* between the two rollers 130, 134 relative to the fixed support 132.

The tension of the belt 60, 60*a*, 60*b*, 60*c* in any of these configurations should be great enough to provide the motive force (frictional force) between the rollers and the belt to drive the belt even at the most aggressive abrasion conditions. The force attempting to restore the belt to its natural path tends to wear the retaining ring 52 and tends to over-polish the edge of the substrate. Therefore, the tension should not be so great as to excessively wear the belt or to provide rapid wear of the edge of the retaining ring if the substrate being polished is slightly displaced from the line directly between adjacent belt rollers.

Figure 11:
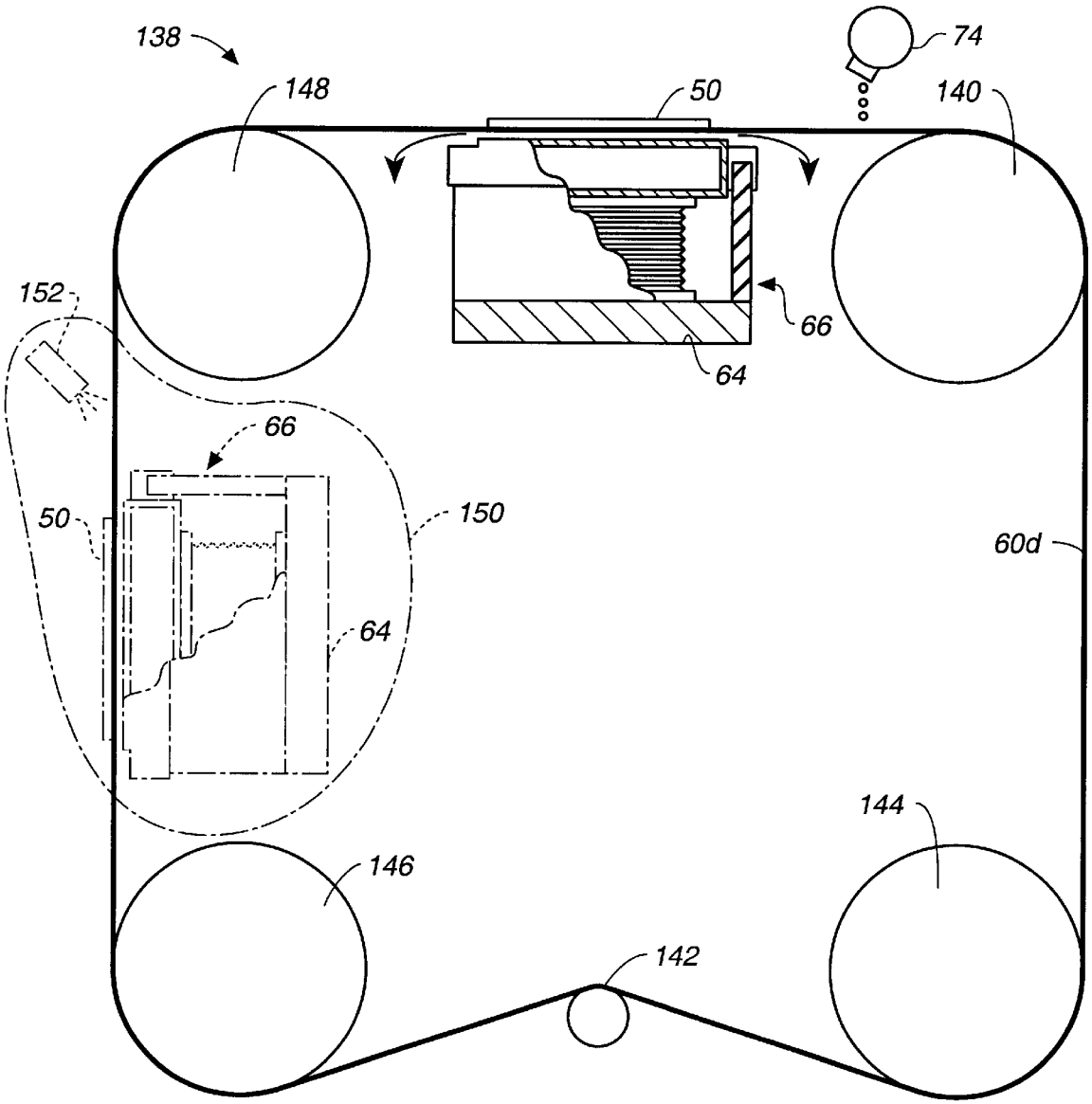
FIG. 11 shows a configuration according to the invention showing the polishing location on the top side of a set of four membrane rollers with the substrate on top of the polishing membrane, and an alternate arrangement with the polishing location on a vertical leg of travel, the polishing heads not being shown.

FIG. 11 shows a configuration according to the invention including four rollers 138, 140, 144, 146. The drive roller 146 is tensioned by a tensioning roller 142. The polishing location is on the belt 60*d* between the top two rollers 140, 148. Gravity influences the membrane polishing belt if it is on a horizontal plane. In an alternate configuration, shown by a dashed line 150 a substrate may be polished on a side of the arrangement. This configuration would eliminate the effect of gravity on the polishing belt 60*d*. A spray nozzle 152 can spray chemical solutions and/or slurry onto the belt as it approaches the substrate 50 being polished.

FIG. 12 shows a wide flexible polishing membrane 60*e* having two polishing positions identified by substrates 50*a* and 50*b*. The locations of membrane backing assemblies 62*a*, 62*b* (shown in dashed lines) are opposite the positions 50*a*, 50*b* at which polishing can take place. In this configuration each substrate 50*a*, 50*b* being polished has its own separate track on the surface of the belt 60*e*. Another configuration with a reliable belt membrane could have the tracks on which polishing takes place overlaps or coincide, so long as polishing performance specifications are maintained.

FIG. 13 shows an alternate arrangement according to the invention. The substrate 50*c* in FIG. 13 is held in a generally fixed position, either stationary or rotating slowly, in a faceup orientation with respect to the polishing belt 60*f* and its carrier (items including rollers 160, 162, and narrow belt backing assembly 164). A set of two rollers 160, 162 (as shown in FIG. 13, although more are possible) move polishing belt 60*f*. Polishing belt 60*f* is narrower than the substrate 50*c* surrounded by a retaining ring 52*a*. The belt carrier mechanism includes a backing assembly 164 which moves with the rollers as the rollers move from side to side. While a single linear side to side movement is shown in FIG. 13 by arrows 166, it is possible the that the membrane polishing assembly (carrier) will rotate as well as translate, instead of or in addition to the substrate rotating providing a similar polishing effect as when the substrate alone rotates. Alternatively, the substrate could move laterally with respect to the belt.

FIG. 14 is a closeup view of the membrane backing assembly showing a series of bellows 174, 176 which are equally pressurized to provide a generally uniform pressure to the backside of the moving flexible membrane 60*f* so that polishing across the width of the substrate is generally uniform.

Figure 15:
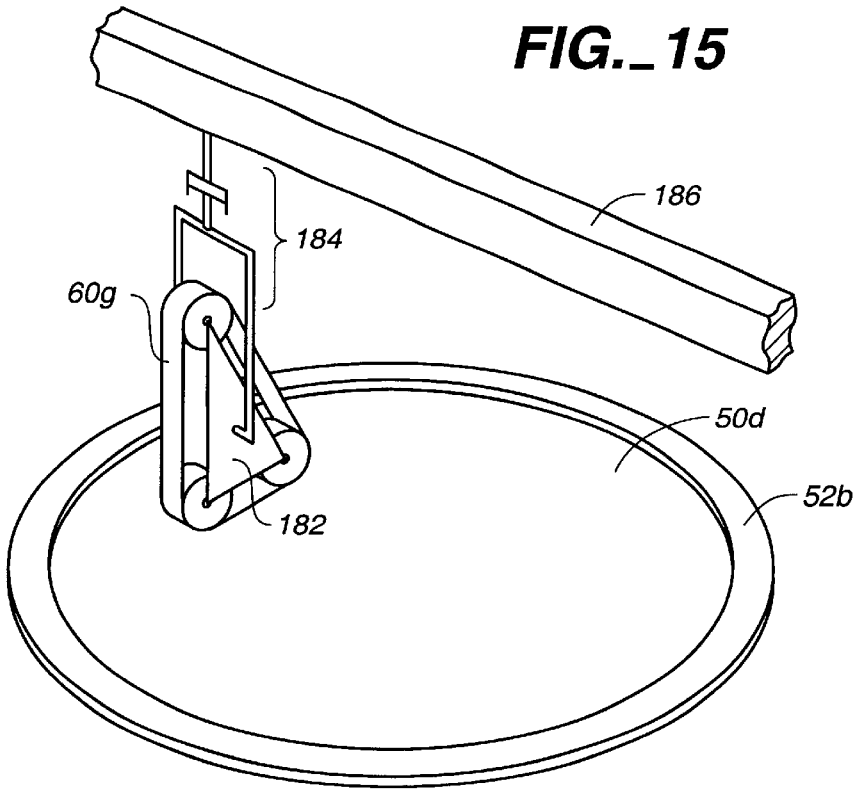
FIG. 15 is a perspective view of a belt polishing head/carrier according to the invention for use in a relative motion which sweeps over the surface of the wafer in a predetermined pattern for uniform polishing of the surface of the wafer.
Figure 16:
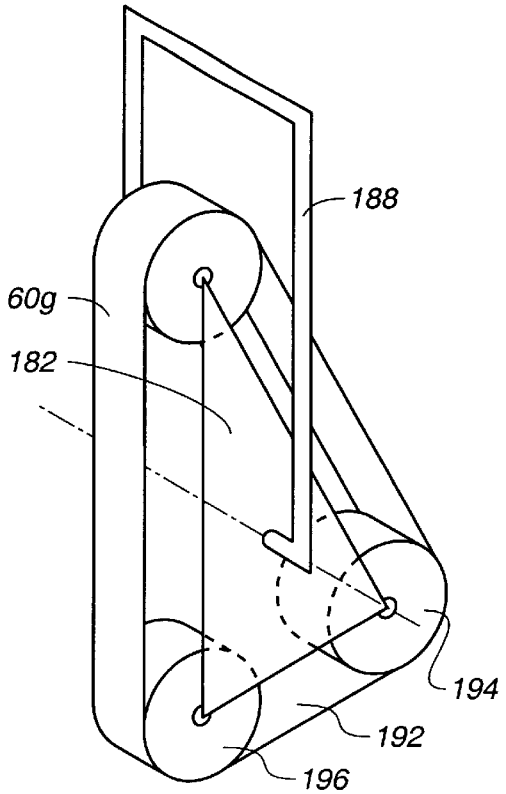
FIG. 16 shows a close-up view of the polishing membrane carrier assembly shown in FIG. 15.
Figure 17:
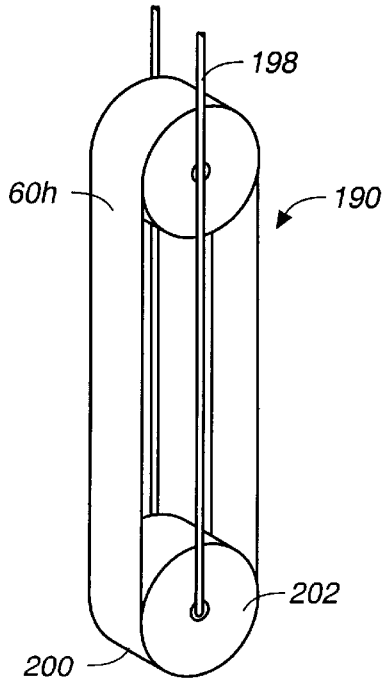
FIG. 17 shows a two roller generally vertical orientation for a polishing head/carrier of the type shown in FIG. 15.

FIG. 15 shows another embodiment according to the invention. A substrate 50*d* is retained within a retaining ring 52*b* and a flexible polishing membrane 60*g* is wound around a series of rollers which provide a belt polishing contact area much smaller than the area of the substrate 50*d*. Examples of alternate roller carriers are illustrated in FIGS. 16 and 17. Such carriers are attached and guided by a carrier linkage (or mechanism) 184 connected to, for example, a bridge support 186. Carrier linkage 184 causes the roller carrier to move across the surface of the substrate 50*d* in a pre-programmed pattern, possibly rotary, to provide uniform polishing of the substrate 50*d* surface. The retaining ring 52*b*, similar to the retaining rings discussed above, minimizes edge effects which cause differential polishing at the perimeter.

An urging linkage, as provided, for example, in the linkage 184, can be provided to attempt to provide uniform polishing pressure as the pre-programmed polishing path is carried out by the carrier assemblies.

A series of three rollers and a carrier are shown in FIGS. 15 and 16. A centralized pivoting frame 188 equalizes the pressure on the substrate between the two rollers so that generally equal polishing occurs within the region covered by the belt between the rollers. Because the distance between the rollers 194 and 196 is small, the polishing belt path 192 generally maintains contact with the surface of the substrate 50*d* as long as the each of the rollers 194, 196 also do. A backing plate assembly may be placed between the rollers 194, 196 to provide uniform pressure the polishing belt path 192.

When a carrier according to FIG. 17 is used, a very small area (almost a line contact) is made between the roller 202 and belt 60*h* at the location 200 in contact with the substrate 50*d*. The carrier 190 moves in a preprogrammed manner over the surface of the substrate as guided by the carrier links 198 to the support bridge 186. The configuration of FIG. 17 is more like the stylus or cutter tool of a lathe. If there is relative rotation between the substrate and the carrier, the polishing program directing the movement of the carrier takes into account the fact that surface speed of a rotating substrate is greater the larger the distance from the center of rotation. The polishing program makes accommodations so that the center of the substrate is not polished any more or less than any of the regions away from the center. Alkaline solution and colloidal particles can be introduced by mounting a slurry and/or alkaline solution drip to the carriers so that fluid is introduced ahead of the locations where the polishing roller carrier is about to travel.

FIGS. 18, 19, 20, 21, 22, 23, 24 and 25 schematically show a variety of arrangements of the polishing head, the substrate, and the polishing membrane backing assembly (faceplate), according to the invention. In each configuration the substrate 210 to be polished is located above the polishing belt 212 and a fixed support is provided both above and below the belt, but there are variations in the assemblies in the supports and the belt.

Figure 18:
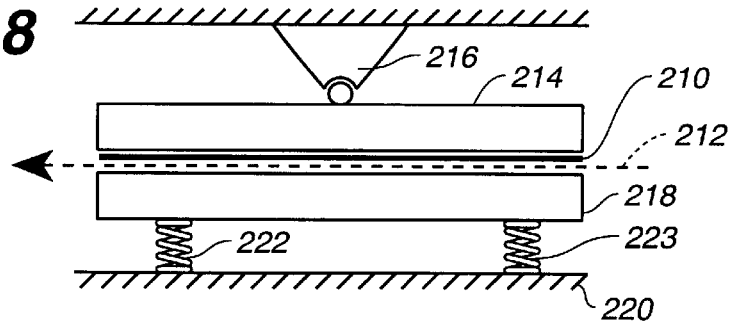
FIGS. 18, 19, 20, 21, 22, 23, 24 and 25 show a variety of schematic arrangements of the polishing head, the substrate, and the polishing membrane backing assembly (faceplate), according to the invention.

FIG. 18 shows a vertically fixed gimbaled 216 polishing head 214, and the backing faceplate 218 is supported by a set of fixed or variable spring members 222,223 from a lower fixed support 220. Only rubbing contact is provided between the backing faceplate 218 and the bottom of the belt 212.

Figure 19:
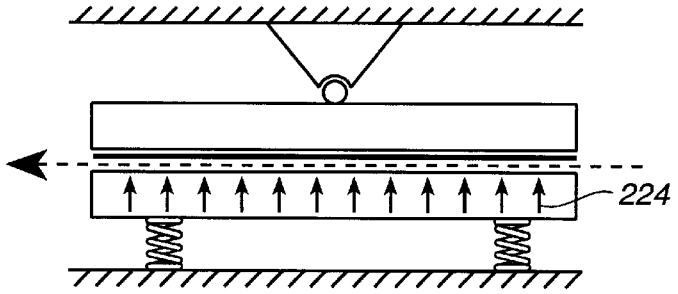

FIG. 19 shows a configuration like FIG. 18, except that a backing faceplate 244 provides a fluid layer contact between the bottom of the belt 212 and the top of the faceplate 224.

Figure 20:
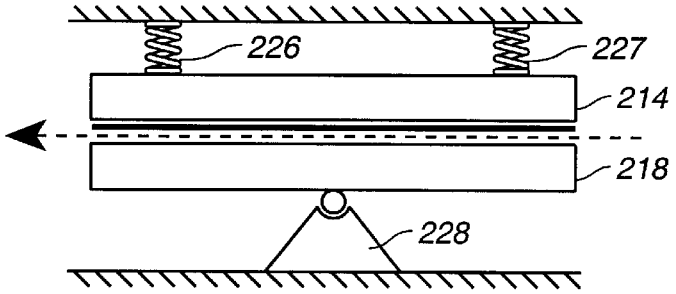

FIG. 20 inverts the fixed and spring elements of FIG. 18. The polishing head 214 in this configuration is urged by fixed or adjustable spring members 226, 227 toward the polishing belt 212. A bottom faceplate 218 which rubs the belt 212 is vertically fixed by the gimbaled support 228.

Figure 21:
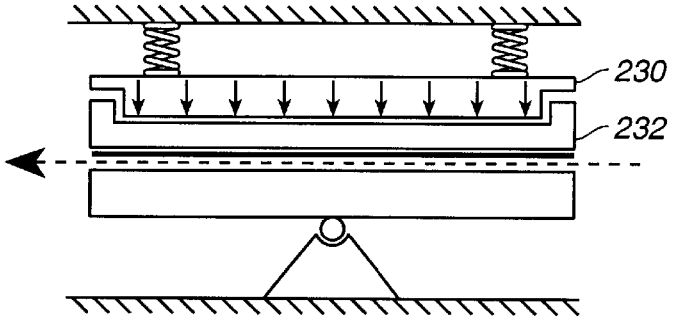

FIG. 21 is a variation of the configuration of FIG. 20 in which a two piece polishing head 230, 232 having a fluid layer interface assures a uniform pressure across the head on the belt 212.

Figure 22:
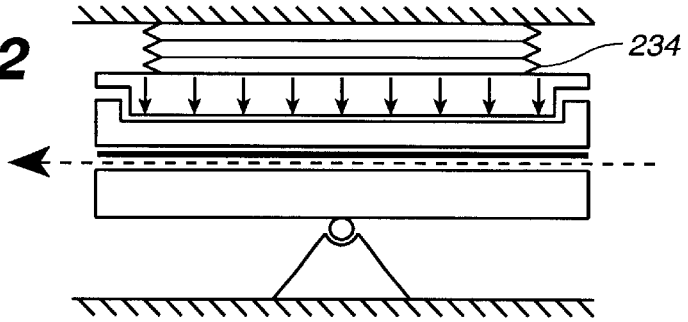

FIG. 22 is a variation of the configuration of FIG. 21 in which a bellows 224 replaces the spring members of FIG. 21. The bellows pressure may be controlled, or the bellows may be closed and provide a reduced force at greater extensions and a greater force on compression.

Figure 23:
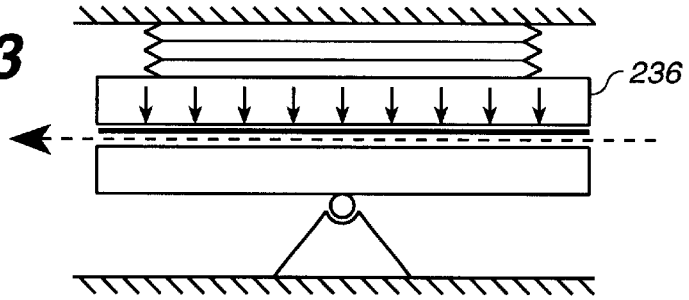

FIG. 23 is variation of the configuration of FIG. 22 in which a polishing head 236 provides fluid force directly to one side of the wafer being polished without any intervening elements. This arrangement provides uniform pressure over each unit of substrate area urging the substrate toward to belt 212 for polishing.

Figure 24:
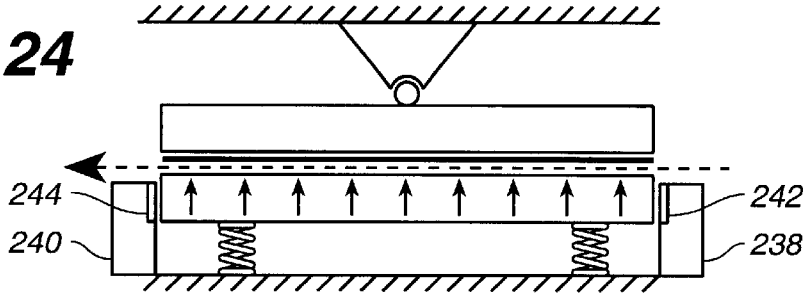

FIG. 24 shows a configuration similar to that shown in FIG. 19 with the addition of sidewalls 238, 240, sidewalls 238, 240 each have friction reducing inserts 242, 244, respectively, to reduce the friction caused by any vertical motion between the backing faceplate 224 and the sidewalls 238, 240.

Figure 25:
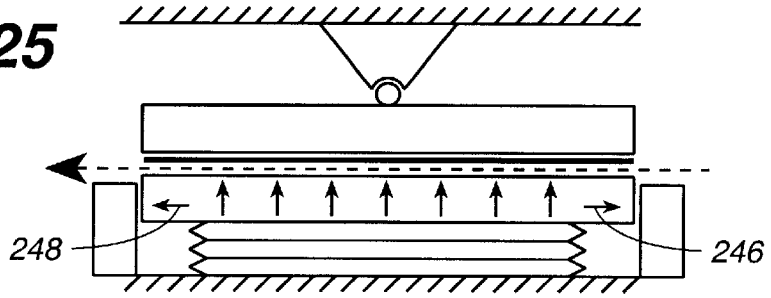

FIG. 25 shows a configuration according to the invention similar to that shown in FIG. 24. A bellows element, as explained for FIG. 22 above, is interposed between the backing faceplate 218 and the fixed support 220. Fluid nozzles 246, 248 are provided to separate the backing faceplate from the side walls.

Use of the configurations as described above includes a method according to the invention including the steps of: holding a substrate 50 in contact with linearly moving flexible polishing membrane 60 and providing a generally uniform pressure to the substrate 50 to accomplish generally uniform polishing across the area of the substrate 50. The step of applying uniform pressure is accomplished by pressurizing a bellows 234 (FIG. 22). Bellows 234 can be positioned between a substrate holder fixed support 32 and the substrate holder 30. The pressure within the bellows 234 is controlled to be generally uniform.

Bellows 100 can also be positioned between which is used as a member intermediate the membrane backing support bridge 64 and the side of the polishing membrane 60 opposite the substrate 50 being polished. The backing faceplate 78 includes a series of holes 80 in its surface through which pressurized fluid flows to create a fluid layer. 108 separating the polishing membrane 60 from the surface of the backing faceplate 78.

The substrate 50 can be rotated during polishing and can be moved in an oscillatory motion generally perpendicular to the relative motion between the belt 60 and the substrate 50.

An alternate method according to the invention includes the steps of: holding a substrate 50 in contact with the flexible polishing membrane 60 opposite a backing faceplate position (corresponding to the membrane backing assembly 62) behind the flexible membrane 60 and moving the polishing membrane 60 in a generally linear path past the substrate 50 to polish the substrate 50. A further additional steps may include: providing a clamping force to urge the substrate 50 and the backing faceplate 78 toward the other and in contact with the flexible membrane 60, and or reconditioning the flexible membrane 60 (e.g., by the rollers 114, 122) as it is moved toward the polishing location where the substrate 50 is polished.

Figure 26:
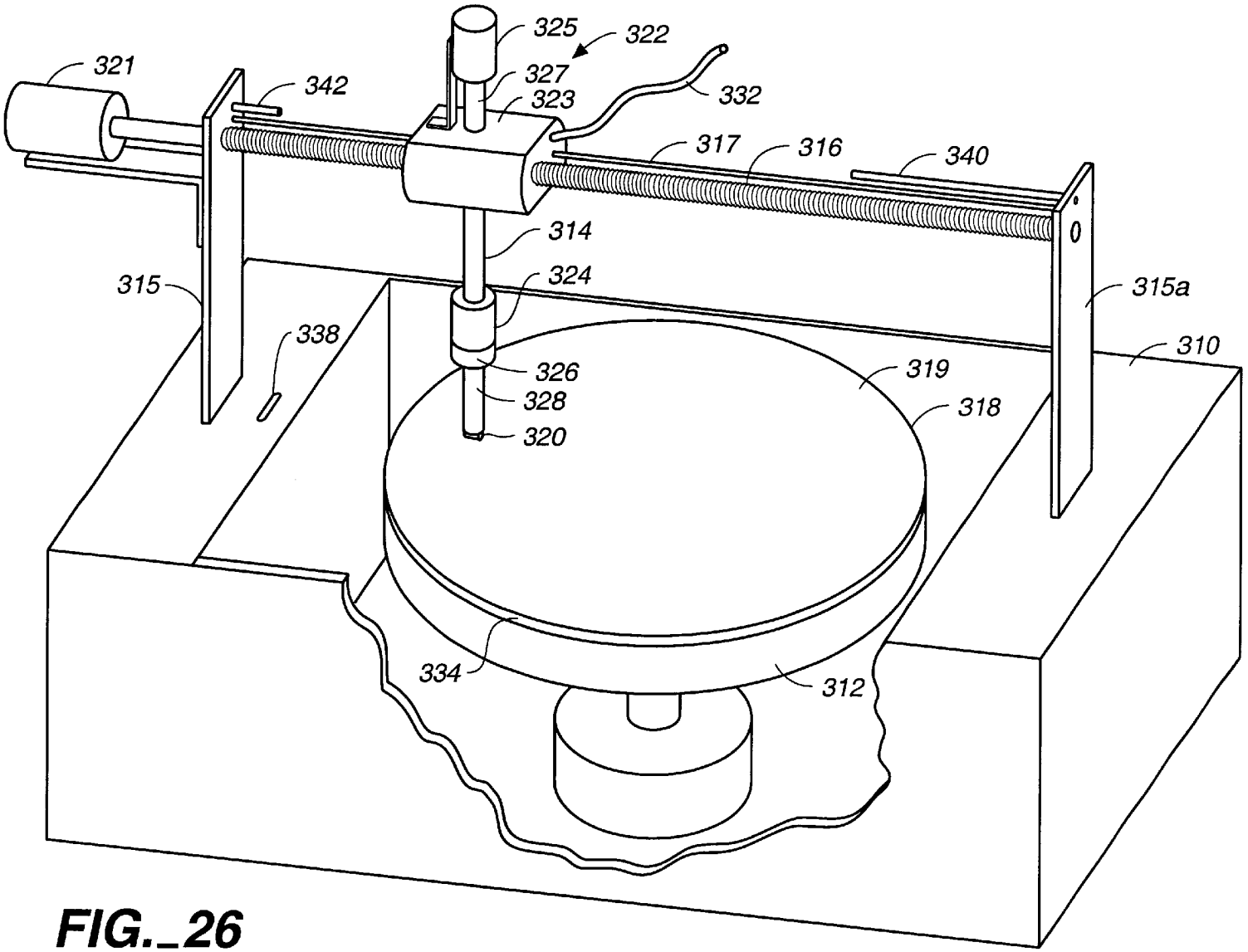
FIG. 26 is a perspective view partially cutaway of another embodiment of the chemical mechanical polishing apparatus according to the present invention.

Referring to FIG. 26, another chemical mechanical polishing apparatus according to the present invention generally includes a base 310 for rotatably supporting a rotating plate 312 therein, and a moveable tubular polishing arm 314 suspended over the rotating plate 312 and supported in position on a cross arm 316. Cross arm 316 is maintained on the base 310, and over the plate 312, by opposed uprights 315, 315*a* which extend upwardly from the base 310. The rotating plate 312 preferably includes a conformable pad 334 fixed to its upper surface. A substrate 318 having an upper surface 319 to be polished, is placed on the conformable pad 334 with its upper surface 319 exposed opposite the plate 312. The conformable pad 334 is wetted, so that surface tension will adhere the substrate 318 to the conformable pad 334 to maintain the substrate in position on the conformable pad 334 as the substrate 318 is polished. The tubular polishing arm 314, with a polishing pad 320 located over the lower open end 328 thereof, is moved generally radially across the upper surface 319 of the substrate 318 to perform the polishing. The polishing pad 320 is preferably continuously moved linearly across the rotating upper surface 319 of the substrate 318, from the edge to center thereof, until the polishing end point is reached. The polishing pad 320 is preferably five to fifty millimeters wide. Therefore, when a five, six, seven or eight inch (125–200 mm) substrate is located on the plate 312 the surface area of the polishing pad 320 is substantially smaller than the overall substrate area to be polished, generally at least three times smaller, and preferably at least 10 times smaller. The polishing pad 320 material is preferably a polyurethane impregnated polyester felt such as IC 1000, or Suba IV, both of which are available from Rodel, Inc. of Newark, Pa. To provide controllable substrate surface material removal rate across the entire substrate 318, the polishing arm 314 and cross arm 316 are provided with apparatus to control the positioning, and load, of the polishing arm 314 and polishing pad 320 with respect to substrate upper surface 319.

The positioning of the polishing arm 314, with respect to the substrate 318, is provided by a linear positioning mechanism 322 formed as an integral part of the cross arm 316. In one embodiment, as shown in FIG. 26, the linear positioning assembly 322 includes an internally-threaded slide member 323, and cross bar 316 includes mating threads to receive slide member 323 thereon. A secondary cross bar 317 is attached to uprights 315, 315*a* generally parallel to cross bar 316. Slide member 323 is received on cross bar 316, and secondary cross bar 317 projects through slide member 323 to prevent its rotation with respect to cross bar 316. A stepper motor 321 is coupled to the cross bar 316 at upright 315 to rotate the cross bar 316 in discrete angular steps. In this configuration, the slide member 323, and polishing arm 314 with the polishing pad 320 attached to the lower open end 328 thereof, may be moved axially across the substrate 318 in increments as small as 0.01 mm by rotating the cross bar 316 in discrete small arcuate steps by stepper motor 321. Other drive means, such as a linear actuator, a geared tape pulley, or other precision positioning mechanism may be easily substituted for this polishing arm 314 drive system.

Referring still to FIG. 26, linear positioning assembly 322 precisely aligns the cross arm 316 over the substrate 318 to move the polishing arm 314 from the edge to the center of the substrate 318. As polishing pad 320 moves from the edge to the center of the substrate 318, the substrate 318 rotates on plate 312, and thus the polishing pad 320 contacts and polishes all areas of the substrate 318. To polish the center of the substrate 318 where the relative motion between the polishing pad 320 and the substrate 318 is at its minimum, the polishing arm may vibrate or rotate to create motion between the polishing pad 320 and the substrate 318 center.

To rotate the polishing arm 314, a servo motor 325 is coupled to slide member 323, and a drive shaft 327 extends from motor 325 into slide member 323 to engage the upper end of polishing arm 314. The upper end of polishing arm 314 is received in a rotary union at the base of slide member 323, which allows polishing arm 314 to rotate and also permits the transfer of liquids or gasses from slide member 323 into the hollow interior of the polishing arm 314. To provide vibratory motion, an offset weight may be coupled to the motor drive shaft 327. As the motor rotates, this offset weight causes the motor 325, and thus slide member and polishing arm attached thereto, to vibrate.

To partially control material removal rate of polishing pad 320, the load applied at the interface of the polishing pad 320 and substrate upper surface 319 is also variably maintained with load mechanism 324 which is preferably an air cylinder, diaphragm or bellows. Load mechanism 324 and is preferably located integrally with polishing arm 314 between cross arm 316 and substrate 318. The load mechanism 324 provides a variable force to load the polishing pad 320 against the substrate 318, preferably on the order of 0.3 to 0.7 $Kg/cm^2$. A load cell 326, preferably a pressure transducer with an electric output, is provided integrally with polishing arm 314, and it detects the load applied by the polishing pad 320 on substrate upper surface 319. The output of the load cell 326 is preferably coupled to the load mechanism 324 to control the load of the polishing pad 320 on the substrate upper surface 319 as the polishing pad 320 actuates across the substrate 318.

To provide the slurry to the polishing pad 320, the slurry is preferably passed through the polishing arm 314 and out the open end 328 of polishing arm 314 to pass through the polishing pad 320 and onto the substrate. To supply slurry to the polishing arm, a slurry supply tube 332 is connected to slide member 323, and passages within the slide member 323 direct the slurry from the supply tube 332 through the rotary union and into the hollow interior of polishing arm 314. During polishing operations, a discrete quantity of chemical slurry, selected to provide polishing selectivity or polishing enhancement for the specific substrate upper surface 319 being polished, is injected through tube 332, slide member 323 and arm 314, to exit through polishing pad 320 to contact the substrate upper surface 319 at the location where polishing is occurring. Alternatively, the slurry may be metered to the center of the substrate 318, where it will flow radially out to the edge of the rotating substrate 318.

Figure 27:
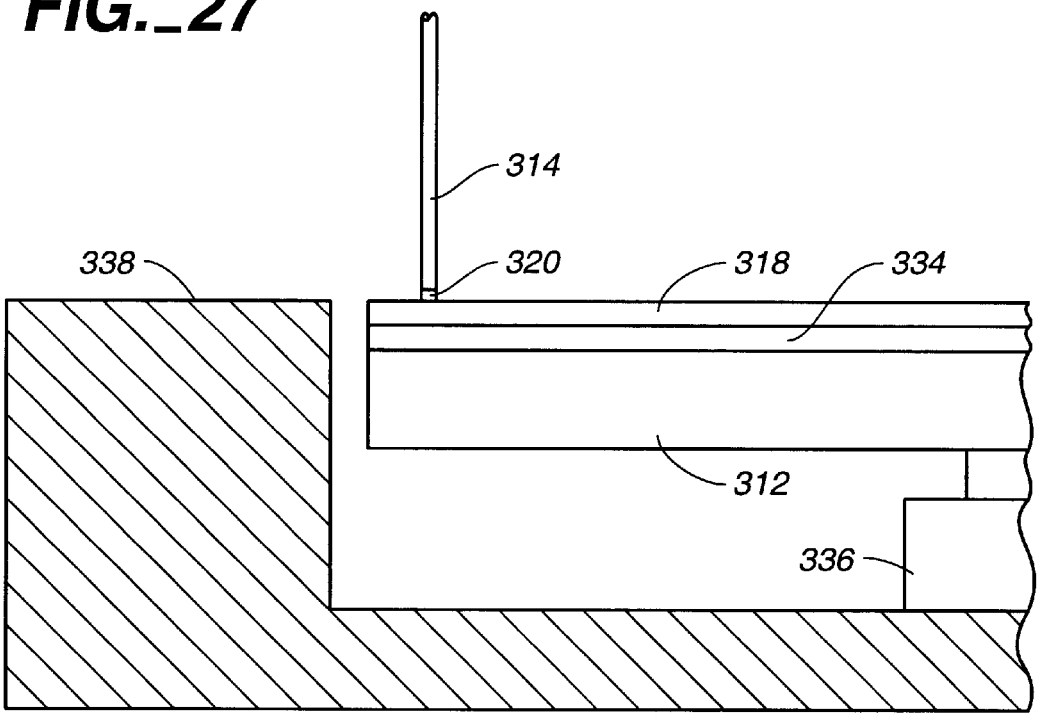
FIG. 27 is a partial side view of the apparatus of FIG. 26 with the side of the base removed

Referring now to FIG. 27, to rotate the plate 312 and the substrate 318 located thereon, a motor 336 is coupled to the underside of the plate 312 with a drive shaft. Motor 336 rotates the plate 312, and is preferably a variably speed direct current motor, such as a servo-motor, which may selectively provide variably substrate 318 rotation speeds during polishing operations.

Referring again to FIG. 26, to polish a substrate 318 with the CMP apparatus of the present invention, the substrate 318 is loaded onto pad 334, and the plate 312 is rotated to the proper polishing speed by the motor 336. The slide member 323 of the linear positioning mechanism 322 moves polishing arm 314 from a position beyond the substrate radial edge to a position adjacent the substrate edge to begin polishing the substrate upper surface 319. As the polishing arm 314 is moved to contact the substrate edge, the polishing pad 320 is passed over a reconditioning blade 338 maintained on base 310 to remove any particulates which may have collected in polishing pad 320 during previous polishing with the polishing pad 320. Blade 338 is preferably a sharp blade, and as polishing pad 320 is brought across it, the fibers of the pad are raised and particulates trapped therein are removed. Other reconditioning apparatus, such as diamond wheels or stainless wire brushed may also be used to recondition the polishing pad. Once polishing pad 320 is brought into contact with the outer edge of the substrate 318, chemical slurry is pumped through the tube 332 and out through polishing pad 320, and polishing arm 314 is rotated and/or vibrated. As the substrate 318 rotates under the polishing pad 320, slide member 323 moves the polishing arm 314 and polishing pad 320 from the substrate edge and across the substrate upper surface 319 to the center of the substrate 318. As the polishing pad 320 is controllably varied by load mechanism 324 to compensate for the decrease in net motion between the polishing pad 320 and substrate upper surface 319 which occurs as the polishing pad 320 approaches the center of the substrate 318. Further, the speed of rotation of plate 312, and thus the net motion between polishing pad 320 and the substrate 318, may be varied in conjunction with, or independently of, the relative radial position of polishing pad 320 on substrate 318 by varying the motor 336 speed. Once the polishing end point is reached, the chemical slurry stops flowing, the rotation and/or vibration stops, and the slide member 323 moves polishing arm 314 across reconditioning blade 338 and back to its original position adjacent the upright 315. To properly position polishing arm 314 for the next substrate 318 to be polished, a zero position stops 342 extends from upright 315, generally parallel to cross arm 316, and slide member 323 stops moving when it engages zero position stop 342. When the next substrate 318 is positioned on the plate 312, and the next polishing cycle begins, the polishing pad 320 will again cross the reconditioning blade 338 to raise fibers in the polishing pad 320 and remove particulates which may have collected in polishing pad 320 as a result of accumulated substrate polishing. Alternatively, the polishing pad 320 may be replaced after each polishing cycle.

Figure 28:
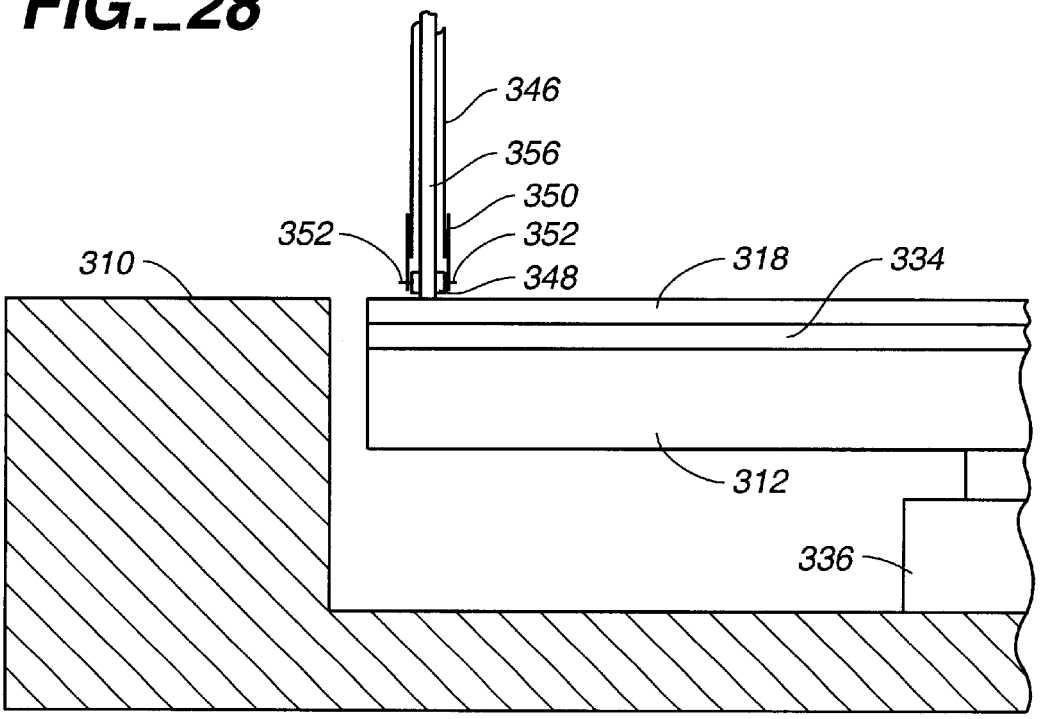
FIG. 28 is a partial side view of an alternative embodiment of the apparatus of FIG. 27.
Figure 29:
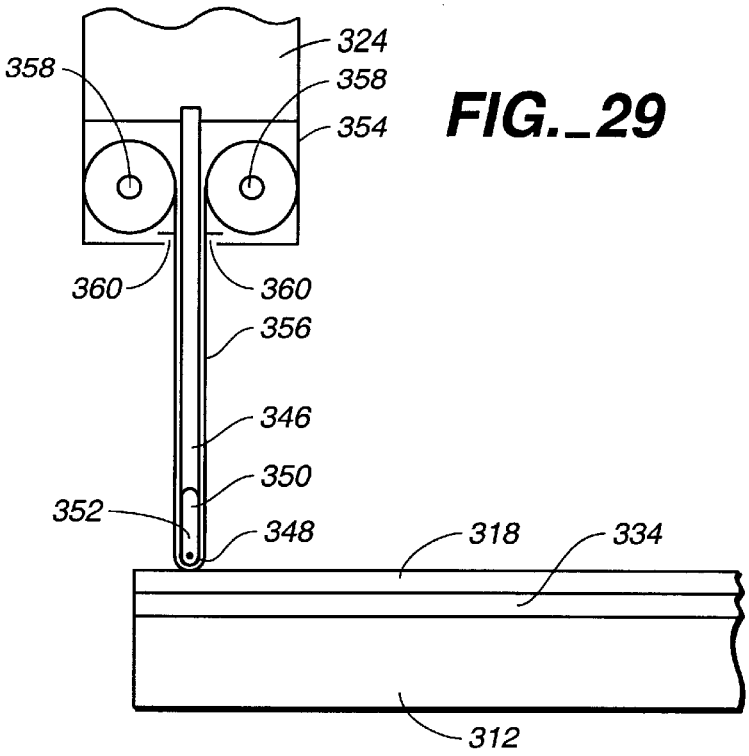
FIG. 29 is a side view of the polishing arm of the apparatus of FIG. 28.

FIGS. 28 and 29 show a second embodiment of the polishing arm 314 useful with the chemical mechanical polishing apparatus of the present invention. In this embodiment, the polishing arm 314 includes a tubular roller support arm 346 which extends downwardly from the load member 324, and a roller member 348 which is attached to the lower terminus of roller support arm 346, by bearing plates 350. The plates 350 are located on opposite sides of the roller support arm 346 and extend downwardly therefrom to receive rotatable roller axle 352 extending from either end of the roller member 348. The roller member 348 preferably freewheels within the plates 350, although it may be coupled to a drive system to be positively rotated. To provide the polishing pad surface to polish the substrate 18, a cassette 354 is loaded on the upper end of the roller support arm 346 and a tape 356 of polishing pad material is looped over the roller 348 such that the ends thereof are wound between spools 358 in the cassette 354. The tape 356 of polishing material is preferably aligned on the substrate by aligning the axles 352 parallel to the radius of the substrate 318. The cassette 354 preferably includes an integral drive motor which rotates the spools 358 to provide a clean polishing pad surface at roller 348 as required. It also optionally includes a pair of reconditioning blades 360 which contact the polishing tape 356 surface to clean it of particulates which accumulate therein from substrate polishing. The tape 356 may be incrementally moved, to provide a clean polishing pad surface on roller 348 after each polishing cycle, or may be continuously or incrementally moved to provide a fresh, clean polishing pad surface at the polishing pad/substrate interface while each individual substrate 318 is being polished. To provide the fresh polishing pad material against the substrate 318, the roller 348 may alternatively by positively driven by a drive mechanism to move the tape 356 over the roller 348 and the substrate upper surface 319, and the reconditioning blade my be located adjacent roller 348. Polishing slurry may be provided, in metered fashion, through the hollow interior of the roller support arm 346 to supply the polishing slurry directly at the polishing pad/substrate interface.

Figure 30:
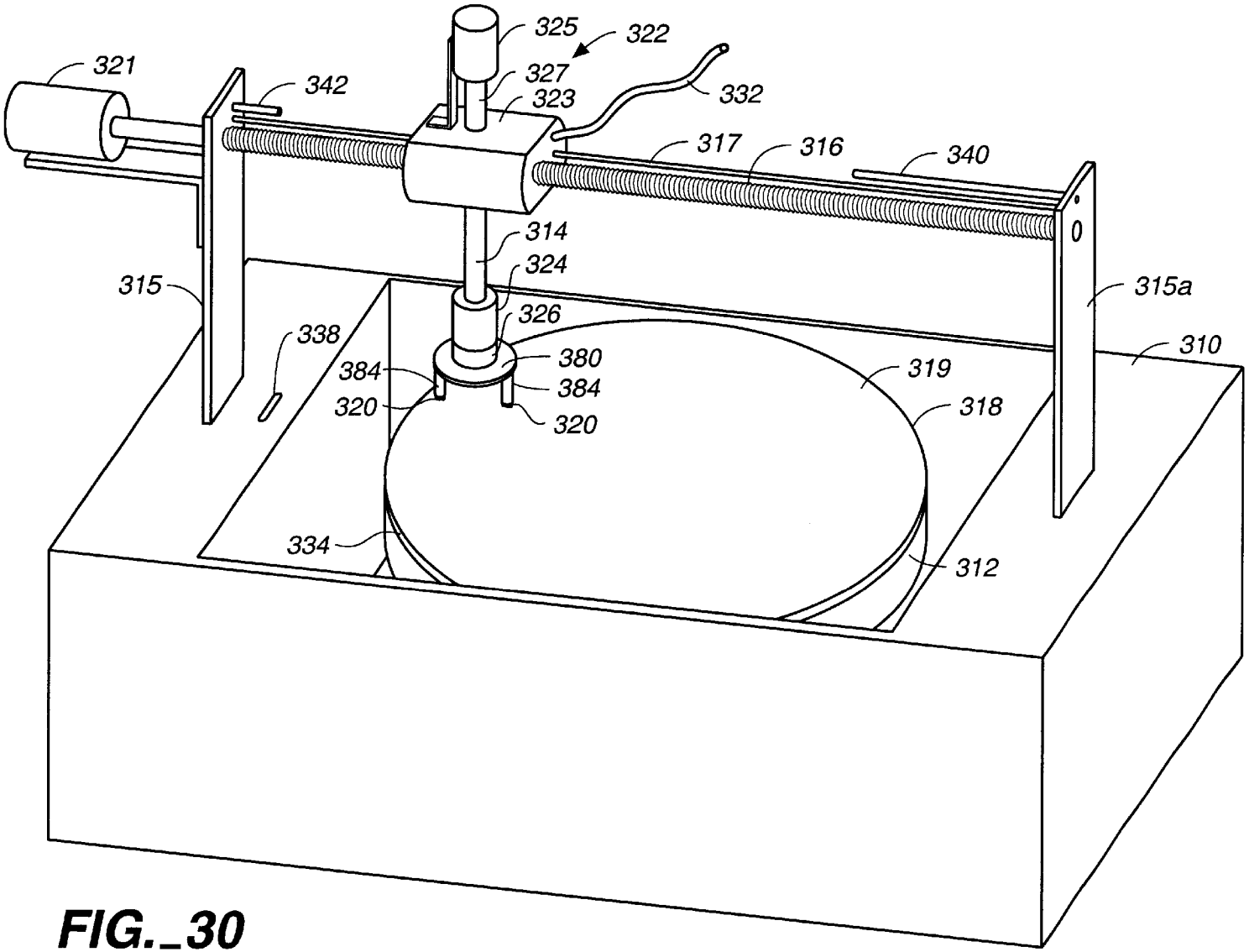
FIG. 30 is perspective view of a further embodiment according to the present invention.

Referring now to FIG. 30, an additional alternative embodiment according to the invention is shown. In this embodiment, polishing arm 314 extends downwardly from load mechanism 324 and terminates on secondary plate 380 located above, and generally parallel to, the rotating plate 312. A pair of secondary polishing arms 384, each having a polishing pad 320 on the end thereof, extend downwardly from intermediate plate 380 to position the polishing pads 320 in position to engage the substrate upper surface 319. Secondary polishing arms 384 are preferably located adjacent the edge of intermediate plate 380, 180 degrees apart, and polishing arm 314 is preferably connected to the center of secondary plate 380. Thus, a polishing arm 314 is rotated by motor 325, secondary polishing arms 384 traverse a circular path having a mean diameter equal to the linear distance between the centers of secondary polishing arms 384. As linear positioning assembly 322 moves polishing arm 314 over the substrate 318, and the secondary polishing arms 384 rotate about the longitudinal axis of the polishing arm 314, net movement will occur between the pads 320 and all areas of the substrate upper surface 319.

To ensure even net relative motion between the polishing pads 320 and the substrate upper surface 19, the length of the span between the secondary polishing arms 384 on intermediate plate 380, in combination with the length of travel of the slide member to position the pads 320 from the edge to center of the substrate, should not exceed the radius of the substrate, and the rate in rpm, and direction, of rotation of both plate 312 and polishing 314 must be equal. Preferably, the span between the centers of the two polishing pads 320 on the ends of secondary polishing arms 384 is 3 to 4 cm. Additionally, although two secondary polishing arms 384 are shown, one, or more than two, polishing arms, or an annular ring of polishing pad material may be connected to the underside of the intermediate plate 80 without deviating from the scope of the invention.

Figure 31:
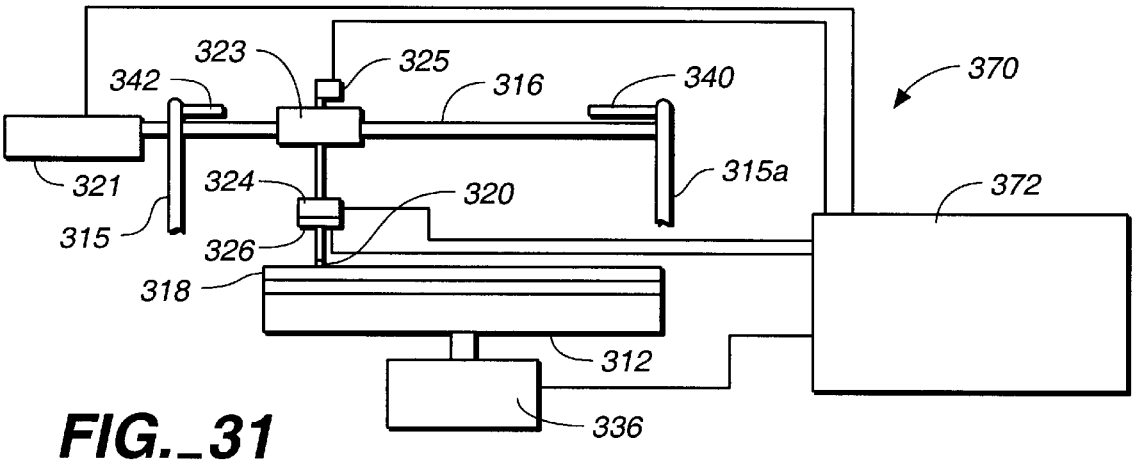
FIG. 31 is a schematic view of the control system used with a chemical mechanical polishing apparatus of the present invention.

Referring now to FIG. 31, a schematic of the control system 370 for controlling the chemical mechanical polishing apparatus of the present invention is shown. The control system 370 includes a controller 372 which is coupled, by electrical cables, to load mechanism 324, load cell 326, plate drive motor 336, cross bar stepper motor 321 and motor 325. When the chemical mechanical polishing apparatus is first used, the controller 372 signals the stepper motor 321 of the linear positioning mechanism 322 to rotate the threaded cross bar 316, and thus move the slide member 323 and polishing arm 314 attached thereto to the fully-retracted position adjacent to upright 15. As slide member 323 positions the polishing arm 314 in the fully-retracted position, a signal member thereon, preferably a signal pin, touches the zero position stop 342 which sends a signal to the controller 372 indicating that the polishing arm 314 is in the fully retracted position. Controller 372 then actuates the stepper motor 321 to move polishing arm 314 to the edge of substrate upper surface 319. As polishing pad 320 is moving into position to engage the edge of substrate 318, the controller 37 starts motor 336 to rotate substrate 318 at the desired speed.

Once polishing pad 30 engages the edge of substrate 318, the controller 372 further signals the load member 324 to create a bias force, or load, at the interface of the polishing pad 320 and the substrate upper surface 319, signals motor 325 to vibrate and/or rotate polishing arm 314, and simultaneously starts the flow of the polishing slurry into polishing pad 320. The controller 372 monitors and selectively varies the location, duration, pressure and linear and rotational relative velocity of the polishing pad 320 at each radial location on the substrate upper surface 319 through the linear position mechanism 322, load member 324, motor 325 and motor 336 until the polishing end point is detected. An end point detector, such as an ellipsometer capable of determining the depth of polishing at any location on the substrate 318, is coupled to the controller 372. The controller 372 may stop the movement of the linear position apparatus 322 in response to end point detection at a specific substrate radius being polished, or may cycle the linear position apparatus 322 to move polishing pad 320 back and forth over the substrate 318 until the polishing end point is reached and detected at multiple points on substrate upper surface 319. In the event of a system breakdown, a stop 340 projects from upright 315*a* generally parallel to cross bar 316 to prevent slide member 323 from travelling completely over the substrate 318. Once polishing end point is reached, the controller 372 signals the load cell of lift polishing arm 314 off the substrate 318, stop delivery of the polishing slurry, and move slide member 323 back into engagement with zero position stop 342. The polished substrate 318 is then removed, and a new substrate 318 may be placed on plate 312 for polishing.

While the invention has been described with regards to specific embodiments, those skilled in the art will recognize that changes can be made in form and detail without departing from the spirit and scope of the invention.

What is claimed is:

1. An apparatus to polish a substrate comprising:

a substrate support to hold a substrate to be polished;

a polishing belt having a front surface to polish the substrate and a back surface;

a belt driver constructed to drive the polishing belt in a generally linear path relative to the substrate; and a backing assembly constructed and arranged to support the back surface of the polishing belt as the substrate is being polished, the backing member including a face plate having a surface to contact the back surface of the polishing belt, a face plate support having walls defining an interior space and supporting the face plate, and a peripheral seal for preventing contaminants from entering the interior space defined by the walls of the face plate support, wherein the peripheral seal comprises a peripheral skirt that hangs over the walls of the face plate support.

2. The apparatus of claim 1 further comprising a biasing member coupled between the face plate and the face plate support to bias the face plate toward the polishing belt.

3. The apparatus of claim 2 wherein the biasing member comprises expandable bellows.

4. The apparatus of claim 1, wherein the face plate and the peripheral seal are movable.

5. An apparatus to polish a substrate comprising:

a polishing belt having an inner surface to polish the substrate and an outer surface;

a substrate support to hold a substrate to be polished in contact with the inner surface of the polishing belt;

a belt driver constructed to drive the polishing belt in a generally linear path relative to the substrate, the belt driver including a plurality of rollers that engage the inner surface of the polishing belt; and a backing member constructed and arranged to support the outer surface of the polishing belt as the substrate is being polished and having a peripheral seal comprising a peripheral skirt.

6. An apparatus to polish a substrate comprising:

a substrate support to hold a substrate to be polished;

a polishing belt having a front surface to polish the substrate and a back surface;

a belt driver constructed to drive the polishing belt in a generally linear path relative to the substrate; and a backing assembly constructed and arranged to support the back surface of the polishing belt as the substrate is being polished, the backing member including a fixed support member, a plurality of fixed walls extending from the fixed support member toward the polishing belt, a movable face plate located laterally interior to the walls and having a surface to contact the back surface of the polishing belt, the face plate, fixed support and walls defining an interior space, a biasing member positioned in the interior space connecting the face plate to the fixed support member to bias the face plate toward the polishing belt, and a movable peripheral skirt including a first part that projects laterally from edges of the face plate and a second part that surrounds the plurality of fixed walls and restricts movement of the face plate away from the polishing belt.

7. An apparatus to polish a substrate comprising:

a substrate support to hold a substrate to be polished;

a polishing belt having a front surface to polish the substrate and a back surface;

a belt driver constructed to drive the polishing belt in a generally linear path relative to the substrate; and a backing assembly constructed and arranged to support the back surface of the polishing belt as the substrate is being polished, the backing assembly including a movable face plate having a surface to contact the back surface of the polishing belt, and a movable peripheral seal that restricts the movement of the face plate away from the polishing belt.

* * * * *